US007306093B2

(12) United States Patent
McLaughlin et al.

(10) Patent No.: US 7,306,093 B2
(45) Date of Patent: Dec. 11, 2007

(54) PACKAGES, PACKAGING SYSTEMS, METHODS FOR PACKAGING AND APPARATUS FOR PACKAGING

(75) Inventors: Michael Ray McLaughlin, Kingsport, TN (US); Charles Duane Mullins, Kingsport, TN (US); Charles Clifton Sanders, Gray, TN (US); Hillard Birdell Smithers, III, Johnson City, TN (US); Gregory Kyle Nelson, Blountville, TN (US)

(73) Assignee: Eastman Chemical Company, Kingsport, TN (US)

( * ) Notice: Subject to any disclaimer, the term of this patent is extended or adjusted under 35 U.S.C. 154(b) by 241 days.

(21) Appl. No.: 10/672,825

(22) Filed: Sep. 26, 2003

(65) Prior Publication Data

US 2004/0159658 A1 Aug. 19, 2004

Related U.S. Application Data

(60) Provisional application No. 60/447,440, filed on Feb. 14, 2003.

(51) Int. Cl.
*B65D 71/00* (2006.01)

(52) U.S. Cl. ..... 206/83.5; 206/442; 206/524.8

(58) Field of Classification Search ..... 206/83.5, 206/204, 524.8, 388, 442; 53/432, 449
See application file for complete search history.

(56) References Cited

U.S. PATENT DOCUMENTS 2,814,382 A * 11/1957 Lassiter ..... 53/408
3,016,581 A 1/1962 Smith
3,095,632 A 7/1963 Smith
3,120,893 A 2/1964 Guenther et al.
3,228,166 A 1/1966 Theil
3,246,443 A 4/1966 Slemmons
3,381,440 A 5/1968 Wullhorst
3,458,966 A * 8/1969 Hullhorst et al. ..... 53/430
3,641,726 A 2/1972 Cassina
3,846,955 A 11/1974 Mattis
3,968,877 A 7/1976 Mattis
4,054,204 A 10/1977 Keeton
4,157,754 A 6/1979 Bartsch et al.

(Continued)

FOREIGN PATENT DOCUMENTS

CH 256 382 2/1949

(Continued)

OTHER PUBLICATIONS

International Search Report, PCT/US2004/004001.

(Continued)

*Primary Examiner*—David T. Fidei
(74) *Attorney, Agent, or Firm*—Michael K. Carrier; Bernard J. Graves, Jr.

(57) ABSTRACT

The present invention relates to the use of vacuum packaging and vacuum packaging techniques. Embodiments of the present invention include bales and packages comprising a sealed chamber having an internal volume at a pressure less than ambient atmospheric pressure. In alternate embodiments of the present invention, the internal volume of the package comprises a bulk material, a bulk fiber material, fibers or fibrous materials. Also disclosed are methods for packaging, packaging systems and apparatus for packaging.

13 Claims, 11 Drawing Sheets

U.S. PATENT DOCUMENTS

| | | | | |
|---|---|---|---|---|
| 4,457,125 | A | | 7/1984 | Fishburne |
| 4,577,752 | A | | 3/1986 | Meredith, Jr. |
| 4,817,365 | A | | 4/1989 | Yawberg et al. |
| 4,942,719 | A | | 7/1990 | Fleissner |
| 4,959,948 | A | | 10/1990 | Fleissner |
| 5,097,956 | A | * | 3/1992 | Davis ..... 206/524.8 |
| 5,174,198 | A | | 12/1992 | Bolstad |
| 5,603,284 | A | | 2/1997 | Freedman |
| 5,622,030 | A | | 4/1997 | Steed et al. |
| 5,775,048 | A | | 7/1998 | Orchard |
| 5,775,058 | A | | 7/1998 | Hirschek |
| 5,921,064 | A | | 7/1999 | O'Connor |
| 5,966,905 | A | | 10/1999 | O'Connor et al. |
| 5,966,906 | A | | 10/1999 | Kuehl et al. |
| 5,979,145 | A | | 11/1999 | Louis et al. |
| 6,035,608 | A | | 3/2000 | O'Connor |
| 6,135,253 | A | | 10/2000 | Weissman et al. |
| 6,202,849 | B1 | | 3/2001 | Graham |
| 6,708,465 | B1 | | 3/2004 | Gustafsson |
| 2002/0117215 | A1 | | 8/2002 | Skeens et al. |
| 2003/0183550 | A1 | | 10/2003 | DiLiberto, Jr. |
| 2004/0159658 | A1 | | 8/2004 | McLaughlin et al. |
| 2005/0161358 | A1 | | 7/2005 | Kern |

FOREIGN PATENT DOCUMENTS

| | | | |
|---|---|---|---|
| DE | OS 1934073 | | 2/1970 |
| DE | OS 1536009 | | 7/1970 |
| DE | 2311252 | | 4/1974 |
| DE | 3444897 | | 6/1986 |
| DE | 69310454 | | 11/1997 |
| EP | 0420071 | A | 4/1991 |
| EP | 0968642 | A2 | 1/2000 |
| FR | 1480095 | | 3/1967 |
| GB | 896228 | | 5/1962 |
| GB | 978686 | | 12/1964 |
| GB | 1108995 | | 4/1968 |
| GB | 1156860 | | 7/1969 |
| GB | 1280932 | | 7/1972 |
| GB | 1 310 029 | | 3/1973 |
| GB | 1310029 | | 3/1973 |
| GB | 1417082 | | 12/1975 |
| GB | 1438481 | | 6/1976 |
| JP | 5314093 | | 2/1978 |
| JP | 5314094 | | 2/1978 |
| JP | 5374994 | | 7/1978 |
| JP | 06-238839 | A | 8/1984 |
| JP | 4833993 | | 8/1999 |
| JP | 2004-34062 | | 2/2004 |
| WO | WO 97/11840 | | 4/1997 |
| WO | WO 02/32238 | | 4/2002 |
| WO | WO 03/089309 | A2 | 10/2003 |

OTHER PUBLICATIONS

Copending U.S. Appl. No. 11/157,066, filed Jun. 20, 2005, Michael Ray McLaughlin et al.

Copending U.S. Appl. No. 11/494,109, filed Jul. 27, 2006, Michael Ray McLaughlin et al.

Copending U.S. Appl. No. 11/514,420, filed Aug. 31, 2006, Michael Ray McLaughlin, et al.

Eastman Chemical Co. confidential shipment of several bales to a customer for evaluation in 1998.

Barcelona, Spain, Trade Show, Nov. 2003.

Pamphlet entitled "Voridian Acetate Tow Technology" (Publication AT-12) (Nov. 2003).

Office Action Summary with Notice of References Cited date of mailing Jan. 17, 2007 for co-pending U.S. Appl. No. 11/514,420.

ISO 527-3—Plastics—Determination of Tensile Properties (1995).

* cited by examiner

PACKAGES, PACKAGING SYSTEMS, METHODS FOR PACKAGING AND APPARATUS FOR PACKAGING

STATEMENT OF RELATED APPLICATIONS

The present application claims priority under 35 USC 119 from U.S. provisional application Ser. No. 60/447,440 filed Feb. 14, 2003, entitled "Packages, Packaging Systems, Methods for Packaging and Apparatus for Packaging for Fibers and Fibrous Materials", the disclosure of which is hereby incorporated herein by reference.

FIELD OF THE INVENTION

The present invention provides new bales, packages, packaging systems, packaging methods and apparatus. Embodiments of the present invention are particularly well suited for use with bulk fiber materials, fibers or fibrous materials, including polymeric fibers such as acetate fibers. Packages of the present invention may have shapes and dimensions advantageous for handling, shipping, storing and/or use of the fibers.

BACKGROUND

Staple items of commerce, including agricultural products, fibers, granular products and the like are often packaged, transported and stored in bulk form. Often these items are packaged, transported and stored in the form of bales. Typically the bale includes a mass of material encircled by restraining straps, cords, wires or the like.

For example, fibers including synthetic and natural fibers, are useful for a wide variety of applications and are found throughout commerce. Many fibers are packaged and transported in bulk in the form of bales. Typically the bale includes a mass of fibers encircled by restraining straps, cords, wires or the like.

Many fibers, and other materials that are typically baled, are resilient and will rebound or spring back when compressed. During a typical baling operation, materials to be baled are compressed under pressure. When released from the applied pressure, the resilient material acts in a manner similar to a spring and expands or springs back causing pressure on all surfaces of the bale. Securing devices and fasteners, including straps, buckles, cords, wires, Velcro and the like are currently used to restrict the bale expansion. Generally a plurality of securing devices are utilized to encircle the bale.

A disadvantage of securing devices such as straps for resilient material bales is that the securing devices provides only localized restraint at its point of contact with the bale. Materials on either side of the securing device are only partially restrained and tend to exhibit spring back causing the bale to bulge in portions between adjacent securing devices. The overall bale acquires a non uniform rounded shape. Further, the dimensions of the overall package may vary over time. Thus, for these reasons, the bales can be difficult to stack or lay flat and therefore may be disadvantageous for storage, transport or use.

Another disadvantage of securing devices for resilient material bales is that the securing devices may cause localized damage, including excess compaction of the material in the bale at the point of contact of the securing device. The damaged or compacted materials may result in difficulties using the material from the bale. For example, damaged or compacted fibers may cause difficulties in pulling fibers from the bale into processing equipment.

A further disadvantage of securing devices for resilient material bales is that the securing devices themselves may be under tension. Thus, upon cutting the securing devices may exhibit springback and be potentially hazardous to users. In addition, portions of the bale may explode upon the release of tension. In order to minimize some of these problems, the amount the materials are compressed may be reduced, thereby disadvantageously reducing the amount of material per unit volume in the bale.

In addition to the disadvantages associated with the use of securing devices, some existing packaging options allow the materials to be exposed to the environment. As a result, the packaged materials may become damaged due to environmental forces, including exposure to moisture, odors, sunlight, dust and the like.

With respect to fibers, many fibers are resilient and will rebound or spring back when compressed. During a typical baling operation, fibers to be baled are compressed under pressure. When released from the applied pressure, the resilient fibers act in a manner similar to a spring and expand or spring back causing pressure on all surfaces of the bale. Securing devices and fasteners, including straps, buckles, cords, wires, Velcro and the like are currently used to restrict the bale expansion. Generally a plurality of securing devices are utilized to encircle the bale.

A disadvantage of securing devices such as straps for resilient fiber bales is that the securing devices provides only localized restraint at its point of contact with the bale. Fibers on either side of the securing device are only partially restrained and tend to exhibit spring back causing the bale to bulge in portions between adjacent securing devices. The overall bale acquires a non uniform rounded shape. Further, the dimensions of the overall package may vary over time. Thus, for these reasons, the bales can be difficult to stack or lay flat and therefore may be disadvantageous for storage, transport or use.

Another disadvantage of securing devices for resilient fiber bales is that the securing devices may cause localized damage, including excess compaction of the fibers in the bale at the point of contact of the securing device. The damaged or compacted fibers may result in difficulties using the fibers from the bale. For example, the damaged or compacted fibers may cause difficulties in pulling fibers from the bale into processing equipment.

A further disadvantage of securing devices for resilient fiber bales is that the securing devices themselves may be under tension. Thus, upon cutting the securing devices may exhibit springback and be potentially hazardous to users. In addition, portions of the bale may explode upon the release of tension. In order to minimize some of these problems, the amount the fibers are compressed may be reduced, thereby disadvantageously reducing the amount of fibers per unit volume in the bale.

In addition to the disadvantages associated with the use of securing devices, some existing packaging options allow the fibers to be exposed to the environment. As a result, the fibers may become damaged due to environmental forces, including exposure to moisture, odors, sunlight, dust and the like.

In view of the foregoing disadvantages associated with current technologies for packaging, it would be advantageous to have new packages and methods for packaging that provide solutions to many or all of the foregoing problems.

SUMMARY OF THE INVENTION

In a general sense the present invention relates to the use of vacuum packaging and vacuum packaging techniques for bulk materials, including bulk commodity products. Bulk commodity products include, but are not limited to, agricultural materials, fibrous materials, textile materials and the like. The present invention provides bales, packages, packaging systems, methods for packaging and apparatus for packaging.

Embodiments of the present invention overcome many of the disadvantages outlined above and provide advantages for the packaging, storage, transport and/or use of bulk materials, particularly fibers and fibrous products.

An aspect of the present invention comprises a bale of bulk material.

In an aspect, the present invention provides packages having an internal volume comprising a bulk material, wherein the internal volume has been placed at a pressure less than ambient atmospheric pressure.

In another aspect, the present invention provides packaging systems comprising materials for forming a chamber capable of being evacuated to a pressure less than ambient atmospheric pressure.

In a further aspect, the present invention provides methods for packaging bulk materials comprising placing the bulk material at a pressure less than ambient atmospheric pressure.

In a still further aspect, the present invention provides apparatus for packaging bulk materials comprising materials for surrounding the bulk materials to form a chamber and an evacuation system. An apparatus of the present invention may further comprise a device for compressing the bulk materials.

The present invention is particularly advantageous for packing of bulk fiber materials, fibers and/or fibrous materials. Examples of fibers advantageous for use in the present invention are set forth below in the Detailed Description of the Invention. Bulk fiber materials, or fibers, include raw fibers, processed fibers, and the like. Fibrous materials include woven fibers, knit fibers, materials produced from fibers, including textiles, and the like. The present invention may also be advantageously utilized to package textile objects conventionally shipped in bales or containers. An embodiment of the present invention wherein the fibrous materials comprise textiles may be distinguished from prior art vacuum sweater bags and suitcase bags due to the bale like characteristics of a textile package of the present invention and/or the barrier materials that may be utilized in embodiments of the present invention.

In an aspect, the present invention provides packages having an internal volume comprising fibers, wherein the internal volume has been placed at a pressure less than ambient atmospheric pressure. The present invention also provides packages having an internal volume comprising bulk fiber materials, wherein the internal volume has been placed at a pressure less than ambient atmospheric pressure. In addition, the present invention provides packages having an internal volume comprising fibrous materials, wherein the internal volume has been placed at a pressure less than ambient atmospheric pressure.

In another aspect, the present invention provides packaging materials useful for the packaging of bulk materials under vacuum. The packaging materials include films, laminates and the like that when sealed are capable of maintaining at least a partial vacuum (an internal pressure inside the packaging material of less than ambient atmospheric pressure) for at least greater than 24 hours, typically greater than 48 hours and preferably greater than 72 hours. In embodiments where the packaging materials of the present invention are utilized for surrounding bulk materials, the packaging materials ideally maintain at least a partial vacuum until expansion forces within the bulk material are neutralized.

In an additional aspect the present invention provides a vacuum outlet assembly useful for the packaging of bulk materials under vacuum. The vacuum outlet assembly comprises a flange portion which includes an outlet adapted to extend through a packaging material to allow access to the internal atmosphere of a package. The flange portion will generally have a surface area larger than the outlet to provide structural support to the outlet. In an embodiment, the flange portion and outlet may be substantially circular with the flange portion having a diameter greater than the outlet, typically at least one and one-half times the diameter of the outlet. In use the flange portion resides in the interior of the package with the outlet extending through a wall of the package to the exterior of the package. The outlet may be adapted for attachment to a vacuum drawing device. In other embodiments, the outlet may comprise a one way valve that permits air to escape from the interior of the package but restricts flow of air into the package. The vacuum outlet assembly may further comprise seals to seal the flange and outlet to the package wall to minimize leakage; a cover or cap to seal the outlet after creation of a vacuum.

In a further aspect, the present invention provides methods for packaging fibers comprising placing the fibers at a pressure less than ambient atmospheric pressure. In a further aspect, the present invention provides methods for packaging bulk fiber materials comprising placing the fibers at a pressure less than ambient atmospheric pressure. In a further aspect, the present invention provides methods for packaging fibrous materials comprising placing the fibers at a pressure less than ambient atmospheric pressure.

In a still further aspect, the present invention provides apparatus for packaging fibers comprising materials for surrounding fibers to form a chamber and an evacuation system. An apparatus of the present invention may further comprise a device for compressing the fibers. In a still further aspect, the present invention provides apparatus for packaging bulk fibers comprising materials for surrounding bulk fibers to form a chamber and an evacuation system. An apparatus of the present invention may further comprise a device for compressing the bulk fibers. In a still further aspect, the present invention provides apparatus for packaging fibrous materials comprising materials for surrounding fibrous materials to form a chamber and an evacuation system. An apparatus of the present invention may further comprise a device for compressing the fibrous materials.

Embodiments of the present invention overcome many of the disadvantages of prior packages and packing methods described in the Background above.

In addition, embodiments of the present invention may have one or more of the following advantages.

In certain embodiments of a package of the present invention external packaging or restraining straps are not required.

In certain embodiments of a package of the present invention the walls provide a moisture barrier that seal the product within from environmental moisture.

In certain embodiments of a package of the present invention the walls provide an odor barrier that minimizes acquisition of odors by the product within the package.

In certain embodiments of a package of the present invention the package dimensions remain substantially constant over time.

In certain embodiments of a package of the present invention the package remains box-like with flat surfaces to enable stacking and storing in a variety of orientations.

In certain embodiments of a package of the present invention, the density (amount) of fibers may be increased by over 10% in comparison to conventional bales.

In certain embodiments of a package of the present invention, package logos or graphics may be included on the external sides of the walls.

In certain embodiments of a package of the present invention, a ruptured package or lack of differential pressure will not cause the package to explode.

In certain embodiments of a package of the present invention, the package may be easily opened.

In certain embodiments of a package of the present invention, the bulk materials, fibers, bulk fiber materials or fibrous materials may be used incrementally after the package is opened.

In certain embodiments of a package of the present invention package dimensions may be tailored to provide ease in palletizing for transport and/or storage.

Embodiments of packaging systems, methods and apparatus of the present invention are advantageous for producing packages of the present invention and other packages.

Further details relating to the features and advantages of the present invention are set forth in the following Detailed Description of the Invention section.

DETAILED DESCRIPTION OF THE INVENTION

Figure 1:
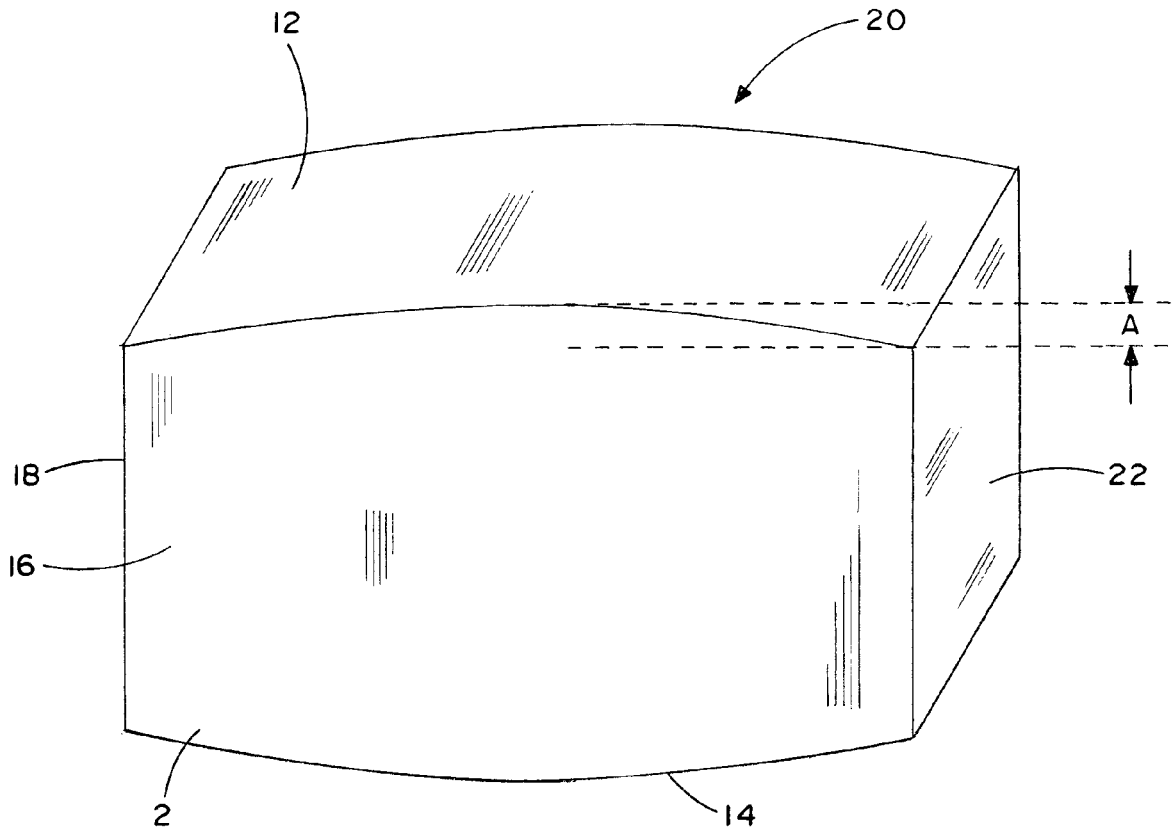
FIG. 1 illustrates an embodiment of a package of the present invention.

The present invention provides bales, packages, component parts of packages, packaging systems, methods for packaging and apparatus for packaging advantageous for use with bulk materials, bulk fiber materials, fibers or fibrous materials.

Embodiments of the present invention may comprise and/or may be used with a variety of materials that are generally packaged, shipped and/or stored in bulk, including materials that are typically packaged, shipped and/or stored in bales. Examples of such materials include but are not limited to agricultural products, including tobacco, bulk fiber materials, fibers, fibrous materials, cotton, cardboard, hay and straw. In this regard, certain embodiments of bales and packages of the present invention may be distinguished from heretofore known packages for consumer products such as coffee, on at least the basis of their size and volume. As will be appreciated from the description herein, a bale of the present invention is advantageous for use as a replacement for conventional bales utilizing straps in applications where bales are used.

Embodiments of the present invention may comprise and/or may be used with a wide variety of fibers, including, but not limited to, staple fibers, tow fibers, textile filament fibers such as:

- acetate: Cellulose acetate, a manufactured fiber in which the fiber forming substance is cellulose acetate. Where not less than 92% of the hydroxyl groups are acetylated, the term triacetate may be used as a generic description of the fiber;
- acrylic: A manufactured fiber in which the fiberforming substance is any long-chain synthetic polymer composed of at least 85% by weight of acrylonitrile units $(—CH_2—CH[CN]—)_X$;
- anidex: A manufactured fiber in which the fiberforming substance is any long-chain synthetic polymer composed of at least 50% by weight of one or more esters of a monohydric alcohol and acrylic acid, $—(CH2{=}CHCOOH]—)_x$;
- aramid: A manufactured fiber in which the fiberforming substance is a long-chain synthetic polyamide in which at least 85% of the amide (—CO—NH—) linkages are attached directly between two aromatic rings;
- azlon: A manufactured fiber in which the fiberforming substance is composed of any regenerated, naturally occurring protein;
- biocomponent: Bicomponent fiber is comprised of two polymers of different chemical and/or physical properties extruded from the same spinneret with both polymers within the same filament;
- cotton;
- wool;
- other natural fibers, for example flax, hemp, angora, fur and the like;
- elastoester: Elastoester is an official US Federal Trade Commission generic fiber type defined as: At least 50% by weight aliphatic polyether and at least 35% by weight polyester;
- glass: including e-glass, s-glass and other mineral fibers;
- carbon fibers;
- lyocell: A cellulose fiber obtained by an organic solvent spinning process where:
  1) "organic solvent" means a mixture of organic chemicals and water, and
  2) "solvent spinning" means dissolving and spinning without the formation of a derivative;
- melamine: A manufactured fiber in which the fiber-forming substance is a synthetic polymer composed of at least 50% by weight of a cross-linked melamine polymer;
- metallic: A manufactured fiber composed of metal, plastic-coated metal, metal-coated plastic, or a core completely covered by metal;
- modacrylic: (A manufactured fiber in which the fiberforming substance is any long chain synthetic polymer composed of less than 85% but at least 35% by weight of acrylonitrile units. $(—CH_2CH[CN]—)_x$;
- nylon: A manufactured fiber in which the fiber forming substance is a long-chain synthetic polyamide in which less than 85% of the amide-linkages are attached directly (—CO—NH—) to two aliphatic groups;

nytril: A manufactured fiber containing at least 85% of a long-chain polymer of vinylidene dinitrile, $(CH_2C[CN]_2—)_x$, where the vinylidene dinitrile content is no less than every other unit in the polymer chain;

olefin: A manufactured fiber in which the fiber-forming substance is any long-chain synthetic polymer composed of at least 85% by weight of ethylene, propylene, or other olefin units;

PBI: A manufactured fiber in which the fiberforming substance is a long-chain aromatic polymer having recurring imidazole groups as an integral part of the polymer chain;

PEN: Polyethylene Naphthalate;

PLA: Polylactide Fiber or Polylactic Acid Fiber;

polyester: A manufactured fiber in which the fiber forming substance is any long-chain synthetic polymer composed of at least 85% by weight of an ester of a substituted aromatic carboxylic acid, including but not restricted to substituted terephthalic units, $p(—R—O—CO—C_6H_4—CO—O—)_x$ and parasubstituted hydroxy-benzoate units, $p(—R—O—CO—C_6H_4—O—)_x$;

polypropylene: A manufactured fiber in which the fiber-forming substance is any long-chain synthetic polymer composed of at least 85% by weight of ethylene, propylene, or other olefin units;

rayon: A manufactured fiber composed of regenerated cellulose, in which substituents have replaced not more than 15% of the hydrogens of the hydroxyl groups;

saran: A manufactured fiber in which the fiber-forming substance is any long-chain synthetic polymer composed of at least 80% by weight of vinylidene chloride units, $(—CH_2—CCl_2—)_X$;

spandex: A manufactured fiber in which the fiber-forming substance is a long synthetic polysulfide in which at least 85% of the sulfide $(—S_n—)$ linkages are attached directly to two (2) aromatic rings;

sulfar: A manufactured fiber in which the fiber-forming substance is a long synthetic polysulfide in which at least 85% of the sulfide $(—S_n—)$ linkages are attached directly to two (2) aromatic rings;

triacetate: Triacetate is derived from cellulose by combining cellulose with acetate from acetic acid and acetate anhydride. The cellulose acetate is dissolved in a mixture of methylene chloride and methanol for spinning. As the filaments emerge from the spinneret the solvent is evaporated in warm air—dry spinning—leaving a fiber of almost pure cellulose acetate. Triacetate fibers contain a higher ratio of acetate-to-cellulose than do acetate fibers;

vinal: A manufactured fiber in which the fiber-forming substance is any long-chain synthetic polymer composed of at least 50% by weight of vinyl alcohol units, $(—CH_2CH[OH]—)_X$, and in which the total of the vinyl alcohol units and any one or more of the various acetal units is at least 85% by weight of the fiber; and vinyon: A manufactured fiber in which the fiber forming substance is any long-chain synthetic polymer composed of at least 85% weight of vinyl chloride units. $(—CH_2CHCl—)_X$;

For the purposes of this specification, unless otherwise indicated, all numbers expressing quantities of ingredients, reaction conditions, and so forth used in the specification are to be understood as being modified in all instances by the term "about." Accordingly, unless indicated to the contrary, the numerical parameters set forth in the following specification are approximations that can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

An aspect of the present invention is a package comprising a sealed chamber comprising bulk materials wherein the chamber has been placed at an initial internal pressure less than ambient atmospheric pressure. Preferably the chamber is hermetically sealed. The sealed chamber may comprise a plurality of walls, including a top wall, a bottom wall and a plurality of side walls defining an interior chamber volume. The sealed chamber may also comprise a bag or similar vessel capable of being sealed, preferably hermetically sealed. Although the invention is described with reference to a substantially box-like (slightly domed rectangular parallelpiped) embodiment comprising walls, embodiments of the invention are not so limited, thus the sealed chamber may take other shapes. The construction and composition of the sealable bag or vessel may be similar to the construction and composition described below with reference to chamber walls.

In embodiments, the walls may be sufficiently flexible and resilient prior to introduction of a vacuum to substantially conform to the geometric volume of bulk materials to be packaged. Similarly, the volume of the bulk materials may provide structural support to the walls.

The walls may comprise polymeric films, for example films comprising: polyethylene ("PE"); polypropylene ("PP"); ethylene vinyl alcohol polymer ("EVOH"); nylon; mylar; polyethylene terephthalate ("PET"); polyethylene terephthalate glycol ("PETG"); polyimides; polyamides; Tyvek® protective material, manufactured and sold by E.I. du Pont de Nemours and Company, Wilmington, Del.; Valéron® Strength Film (described below), manufactured and sold by a division of Illinois Tool Works, Inc.; BO (biaxially oriented) Nylon; LLDPE (linear low density polyethylene)); ULLDPE (ultra linear low density polyethylene), SiOx (silicon dioxide)—Nylon, SiOx—PET or the like and may have varying degrees of flexibility and resilience prior to sealing and introduction of a vacuum. The polymeric films may provide strength and/or puncture resistance. The walls may comprise a single layer or a plurality of layers which may take the form of a laminate construction. As noted, the polymeric films may be coated with ceramic materials, oxides or the like, for example silicon dioxide. A suitable film laminate, for example, may comprise a SiOx Nylon/Valéron®/LLDPE.

The walls may in addition, or in the alternative, comprise metal foils including aluminum, tin, nickel, and/or alloys.

In certain embodiments of the present invention wherein the bulk materials may be subject to degradation by moisture and/or other environmental elements, the walls may provide a gaseous, moisture and/or odor barrier that seals the contents from the external environment.

The walls may further comprise a barrier element, structural support and/or protective element including aluminum and or other metal sheets or grids, cardboard, wood, woven materials comprising synthetic or natural fibers, woven straps or the like. The barrier element may provide a barrier to substances that could adversely affect the bulk materials, for example chemical vapors, water, ultraviolet light and the like. The wall may comprise a laminate including films and these additional layers. Each layer in a laminate may be selected to provide one or more functions, for example an aluminum layer may provide a gas barrier and also provide increased puncture resistance.

Generally, the thickness of the walls will be sufficient to maintain at least a partial vacuum in the interior of the package for up to 24 hours, typically for a period of time sufficient to allow expansive forces within the bulk material being packaged to be substantially neutralized. Typical thicknesses are set forth below.

At least one wall, side, top or bottom, will comprise an evacuator to allow the chamber to be evacuated. As used herein "evacuator" refers to a valve, port, tube, hose or the like that permits gas (e.g. air) to be removed from the interior volume of the chamber. Suitable evacuators include, but are not limited to those known in the art such as a vacuum check valve, vacuum fitment, or a sealable port that will allow the chamber to be evacuated. An example of a vacuum check valve suitable for use in the present invention is described in U.S. Pat. No. 6,056,439, the disclosure of which is hereby incorporated herein by reference. Depending on the application, a plurality of evacuators may be utilized, for example vacuum check valves in one or more walls.

In addition, or in the alternative, to the evacuators described above, embodiment of the present invention may comprise port that is subsequently sealed with a fin seal or a lap seal.

In an aspect, the present invention provides a vacuum outlet suitable for use as an evacuator in embodiments of the present invention. The vacuum outlet is described in more detail below.

The terminology "less than ambient atmospheric pressure" is used in a manner consistent with its ordinary meaning, wherein ambient refers to the altitude above/below sea level and temperature at the site at which the package is formed. Less than ambient atmospheric pressure is also understood to mean a pressure at which at least a partial vacuum begins. Thus, the pressure of the internal volume of a chamber in a package of the present invention will have been placed under at least a partial vacuum.

Standard ambient atmospheric pressure is understood to be a pressure of 101,325 Pascal ("Pa"), 101.325 kPa, at 25 degrees Celsius ("C.") at sea level. As will be understood by those of ordinary skill in the art, atmospheric pressure varies as a function of altitude and temperature, therefore the pressure of less than ambient atmospheric pressure in embodiments of the present invention will vary accordingly. Embodiments of packages of the present invention will generally comprise sealed chambers having an internal pressure between a lower limit determined by the processing equipment's ability to evacuate the chamber to an upper limit of less than ambient atmospheric pressure. In general, embodiments of packages of the present invention will have an internal pressure of 16,000 to below 101,325 Pa, more particularly 40,000 to 92,000 Pa, and in certain embodiments 50,000 to 70,000 Pa.

For embodiments of the present invention wherein the package comprises resilient bulk materials that spring back and exert an outward pressure when compressed into bales, the internal chamber pressure to prevent bale growth will generally be equal to the fiber force per area minus the atmospheric pressure to maintain equilibrium. The internal chamber pressure may be greater or lesser as desired for particular applications. The density of the bale within the chamber may vary with vacuum pressure.

As used herein "sealed" is used in a manner consistent with its generally accepted meaning, as referring to closed substantially completely against the passage of gaseous materials (e.g. air) or other fluids. The extent to which the chamber or package remains sealed will depend, in part, on the permeability of the materials utilized to form the chamber, for example the permeability of a polymeric film.

Advantageous embodiments of the present invention the package should be sufficiently sealed to be able to maintain the initial partial vacuum for at least 2 days. Preferably a package of the present invention will be sufficiently sealed to maintain at least a partial vacuum from the time of initial evacuation to the time the fibers are used. By way of example, the average time between package filling and use for certain industrial applications is 30 days, therefore it is advantageous for a package of the present invention to maintain at least a partial vacuum for at least 45 days. For certain embodiments of the present invention, it will be advantageous for a package to maintain at least a partial vacuum for at least 300 days, or even up to 365 days.

As will be understood from the description contained herein, in certain embodiments, the features and advantages of the present invention may be achieved by placing the internal volume of a chamber comprising bulk materials at a pressure less than ambient atmospheric pressure even though the pressure within the internal volume may change over time, and may ultimately return to ambient atmospheric pressure. The terminology "initial pressure" is used herein to describe the pressure at the time the chamber is first sealed.

As described in more detail below, sealing may be accomplished through conventional methods such as welding, taping, gluing, fusing or otherwise joining wall edges and/or other open portions of the materials that surround the fibers. Suitable welding techniques include heat welding and induction welding. The seals may also be created mechanically through the use of interlocking channels or zipper like portions in a manner similar to Zip-loc bags.

A package of the present invention may further comprise additional walls and/or packaging that is not sealed. For example, a package of the present invention may be placed inside a woven material, bag or cardboard box for shipment and/or storage. In an embodiment, the present invention comprises a sealed package comprising sealed walls sufficient to provide an oxygen barrier and further comprising outer packaging material sufficient to provide an additional moisture barrier. The outer packaging material may also provide additional protection during transportation, shipping and storage.

In addition, the external sides of the walls, or the outer packaging material may comprise printing or graphics.

Embodiments of packages of the present invention may be advantageously stacked when stored. Although it will often be preferred that the packages remain sealed sufficiently to maintain a vacuum, if vacuum is lost in a stacked package, the package may retain substantially the same shape due to the reduction in expansion forces of the fiber resulting from the application of the vacuum. Thus, many of the advantages of the packages of the present invention will remain if the initial vacuum deteriorates over time and before use.

Embodiments of the present invention may have any physical size and be of any dimension without departing from the scope of the present invention.

Certain embodiments of the present invention will have dimensions approximately equal to the dimensions of conventional bales of fibers suitable for use in conventional process equipment, generally 80 to 120 centimeters ("cm") in width by 100 to 150 cm in length by 105 to 155 cm in height. Preferred dimensions for use in conventional process equipment are 95 to 105 cm in width by 115 to 125 cm in length by 120 to 135 cm in height.

For use in commercial process equipment, embodiments of packages of the present invention will generally comprise sealed chambers having internal volumes of 0.9 to 2.3 cubic meters ($m^3$), more particularly 1.2 to 1.8 $m^3$, and in certain embodiments 1.4 to 1.6 $m^3$. In order to be used in certain processing equipment set up for conventional bale sizes, embodiments of packages of the present invention will comprise sealed chambers having internal volumes approximately equal to conventional bales of approximately 1.7 to 2 $m^3$.

Embodiments of packages of the present invention may comprise any shape, including cubical, cuboidal, cylindrical, conical, pyramidal, spherical, substantially spherical, substantially cubiodal or the like. "Cuboidal" is used in a manner consistent with its meaning in geometry wherein it represents a rectangular parallelpiped, e.g. a box-like volume having relatively square corners and a length, width and height that are not all equal. For transport, handling, storage and use, cubical, cuboidal, substantially cubical or substantially cuboidal may be preferred. Embodiments of packages of the present invention designed for use in manners similar to heretofore known fiber bales will preferably have geometric volumes approximating those of fiber bales, i.e. substantially cuboidal.

As will be understood from the description herein, embodiments of the present invention may not have perfectly square corners, and the faces may not be completely planar. For example, as described below, embodiments of packages of the present invention may exhibit a slight crown or arcuate aspect at their top and/or bottom faces. Thus, any description of a shape of an embodiment of the present invention set forth herein should be understood to be used herein to describe the shape generally.

A further aspect of certain embodiments of the present invention is that the packaged bulk materials exhibit a reduced tendency to expand. As a result, the package maintains a substantially uniform shape over time.

An aspect of certain embodiments of the present invention is that the flatness of the bulk materials is increased in comparison to the flatness of a corresponding volume of bulk materials restrained in non-vacuum conditions, for example the walls of the packages may remain substantially flat. In embodiments of the present invention the difference in height between the edge of a wall and a center point of the wall may be less than 8 centimeters ("cm"), preferably less than 5 cm, more preferably less than 3 cm, and in certain embodiments less than 1 cm. For example, with reference to a cuboidal embodiment, the top and bottom walls may be substantially flat, such that the difference in height between the edge of the top or bottom wall, a center point of the top or bottom wall is less than 8 cm, preferably less than 5 cm, more preferably less than 3 cm, even more preferably less than 1 cm. This flatness provides advantages for transportation, storage and use of the packages of the present invention.

A further aspect of certain embodiments of the present invention is that the walls of the chamber may be embossed to facilitate stacking, include graphics or labeling information, or for other purposes. This embossing may be accomplished by creating a positive relief on a portion of a baling platen and/or the bottom of a baling chamber, and using the platen to compress the fibers in the manners described herein. As will be recognized by those of ordinary skill in the art, the "baling platen" is the flat plate of an hydraulic ram assembly used to compress materials. In an embodiment, a package comprises a "positive" embossed portion on a top side and/or a "negative" embossed portion on a bottom side so as to facilitate interlocking of packages when stacked. In an alternate embodiment, the bottom side of the package may be embossed with channels to faciliate the insertion of the fork portion of a fork lift underneath the package. As described herein, when the chamber walls comprise polymeric films, the walls substantially conform to the shape of the mass of the bulk materials contained within the walls.

A feature of certain embodiments of the present invention is that the packages comprise embossed reliefs, for example, on their top and/or bottom, that facilitate handling and storage utilizing conventional fork lifts and similar equipments for moving pallets.

The present invention is advantageous for use with bulk fiber materials, fiber or fibrous materials. An embodiment of the present invention provides a package comprising a sealed chamber having an internal volume at an initial pressure less than ambient atmospheric pressure, the internal volume comprising bulk fiber materials. In another embodiment the present invention provides a package comprising a sealed chamber having an internal volume at an initial pressure less than ambient atmospheric pressure, the internal volume comprising fibers. In a further embodiment the present invention provides a package comprising a sealed chamber having an internal volume at an initial pressure less than ambient atmospheric pressure, the internal volume comprising fibrous materials. Details relating to the package are set forth above with reference to embodiments of the present invention comprising bulk materials.

An advantage of certain embodiments of the present invention is that the density of the materials or fibers in a package of the present invention may be increased in comparison to the density of a corresponding volume of the materials or fibers in non-vacuum conditions, for example conventional bales restrained by straps. Embodiments of the present invention may exhibit a density increase of fibers or materials within the package of 1.1 to 2.0 times, typically 1.1 to 1.5 times the density of similar fibers or materials packaged in a bale with restraining straps.

An additional advantage of certain embodiments of the present invention is that the density of the fibers or materials within a package of the present invention may be substantially uniform A further advantage of certain embodiments of the present invention is that the overall weight of a package of the present invention may be increased in comparison to the weight of a corresponding volume of the fibers or materials in non-vacuum conditions, for example conventional bales restrained by straps. Embodiments of the present invention may exhibit a 1.1 to 2 times increase in weight, typically 1.1 to 1.5 times increase in weight, over a conventional bale with restraining straps of approximately the same volume.

An embodiment of the present invention may exhibit one or more of these advantages or other advantages described herein.

The density of the materials or fibers in a package of the present invention and the overall weight of the package will depend on the composition of the materials or fibers in the package. By way of example, a substantially cuboidal (box-like) embodiment of the present invention comprising acetate tow fibers of 95 to 105 cm in width by 115 to 125 cm in length by 120 to 135 cm in height may have an overall mass of 825 to 1175 kg, typically 880 to 1130 kg. The density of the fibers in the package may range from 0.2 to 0.9 grams per cubic centimeter (g/cc), typically 0.48 to 0.82 g/cc, often 0.50 to 0.78 g/cc.

Further details relating to embodiments of packages of the present invention are set forth below with reference to the appended figures.

In another aspect, the present invention provides a packaging system, or kit, for packaging bulk materials, including bulk fiber materials, fibers and fibrous materials. In an aspect the packaging system comprises a sealable chamber, the chamber comprising an evacuator.

In an embodiment the packaging system may comprise a plurality of walls capable of being sealed to each other to form a sealed chamber, preferably a hermetically sealed chamber. Each wall may be provided with pre-folded edges or flaps to provide a sealing surface. In an alternate embodiment the walls may be lap sealed to each other. At least one wall will further comprise at least one evacuator, such as a vacuum fitment, vacuum fitment check valve, or port to permit drawing of a vacuum from the chamber after assembly. Alternatively, a packaging system may comprise a sealable bag or vessel. The features of the packaging system are substantially similar to those set forth herein with respect to a package of the present invention.

In a further aspect the present invention provides a method for packaging bulk materials comprising forming a sealable chamber around a volume of bulk materials, evacuating the chamber to create an internal pressure within the chamber less than ambient atmospheric pressure and sealing the chamber.

The method may further comprise compressing the volume of bulk materials. The compressing step may occur prior to complete formation of the chamber around the volume of bulk materials, or may occur after the chamber is formed prior to evacuating the chamber or both.

In a further aspect the present invention provides a method for packaging bulk fiber materials, fibers or fibrous materials comprising forming a sealable chamber around a volume of materials or fibers, evacuating the chamber to create an internal pressure within the chamber less than ambient atmospheric pressure and sealing the chamber.

The method may further comprise compressing the volume of materials or fibers. The compressing step may occur prior to complete formation of the chamber around the volume of materials or fibers, or may occur after the chamber is formed prior to evacuating the chamber or both.

With respect to the foregoing embodiments of methods of the present invention for packaging bulk materials, bulk fiber materials, fibers or fibrous materials, the evacuation of the chamber will create at least a partial vacuum in the chamber, in effect an internal pressure less than ambient atmospheric pressure. To minimize the tendency for a volume of materials or fibers to exert an outward pressure, for example due to spring back, the evacuation should be at least sufficient to create a vacuum pressure after sealing of the chamber equal to the force exerted by the materials or fibers per unit area minus the atmospheric pressure. The evacuation may be conducted to obtain an internal pressure within the chamber less than the force exerted by the materials or fibers per unit area minus atmospheric pressure, and in certain embodiments substantially less than the force exerted by the materials or fibers per unit area minus the atmospheric pressure. The pressure pulled by the vacuum will generally be greater than or equal to the forces exerted by the fibers per unit area.

The step of forming a sealable chamber may comprise the steps of assembling a plurality of walls, including a top wall, a bottom wall, and a plurality of side walls. The walls may be assembled by assembling and sealing individual wall panels to each other. In certain embodiments one or more walls may be formed from a single piece of material that is folded or creased. Alternatively, with respect to a sealable bag or vessel, the step of forming a sealable chamber may comprise the steps of placing materials or fibers within the bag or vessel and then sealing the opening.

A feature of an embodiment of a method of the present invention is that a step of compressing the materials or fibers may be utilized to create a partial vacuum in the chamber, in effect a pressure less than ambient atmospheric pressure. For example, materials or fibers may be placed in a sealable chamber comprising a vacuum check valve, the chamber sealed, and then the fibers compressed while within the sealed chamber. During compression, air and gases in the chamber are forced out of the chamber through the vacuum check valve. As a result, at least a partial vacuum, and pressure less than ambient atmospheric pressure, is created within the sealed chamber upon release of the compressive force once equilibrium is reached.

The steps of a method of the present invention may be performed in different orders. In an embodiment, a method of the present invention comprises: providing materials or fibers; compressing the materials or fibers; forming a sealable chamber around the materials or fibers; sealing the chamber; evacuating the chamber and then releasing compression.

In an alternative embodiment, a method of the present invention comprises: providing materials or fibers, forming a sealable chamber around the materials or fibers; sealing the chamber; compressing the materials or fibers while allowing air within the chamber to escape to thereby at least partially evacuate the chamber; and then releasing compression.

In another embodiment, a method of the present invention comprises: providing materials or fibers; compressing the materials or fibers; restraining the compressed materials or fibers; releasing compression; forming a sealable chamber around the materials or fibers; sealing the chamber; evacuating the chamber and then releasing the restraint.

In addition to the foregoing steps, embodiments of the present invention may further comprise a step of surrounding the sealed package with additional packaging material.

A feature of certain embodiments of the present invention is that due to the reduced expansion forces within the materials or fibers, a package of the present invention may be more easily surrounded with additional material, for example after removal from baling equipment.

Further details relating to embodiments of methods of the present invention are set below.

In a further aspect, the present invention provides apparatus advantageous for packaging bulk materials. A further aspect of the present invention is an apparatus for packaging bulk fiber materials, fibers or fibrous materials.

An embodiment of an apparatus of the present invention may comprise a packaging system of the present invention. The embodiment may further comprise an evacuation system. In addition, or in the alternative, the embodiment may still further comprise a device for compressing a mass of bulk materials.

In an alternative embodiment, an apparatus of the present invention comprises materials for forming a sealable chamber and a device for compressing a mass of materials or fibers. The materials or fibers may be compressed while within the chamber or compressed and then surrounded by the chamber. Materials for forming a chamber in an apparatus of the present invention comprise materials identified herein as suitable for forming the walls or chamber in a package of the present invention. A device for compressing a mass of materials or fibers may comprise commercially available baling equipment. In general, such baling equipment includes a vessel for placing a mass of materials or fibers, a hydraulic ram for compressing the mass of materials or fibers, and motors and process controls to operate the ram.

An evacuation system suitable for an apparatus of the present invention may include vacuum equipment and associated hoses. The evacuation system should be capable of evacuating a chamber containing materials or fibers to a pressure less than ambient atmospheric pressure, preferably to a pressure discussed herein with reference to a package of the present invention. An example of an evacuation system comprises a vacuum producing device and associated hoses for connecting the device to the chamber. The evacuation system may further include a motor and process controls for operating the machinery used to pull a vacuum.

Further details relating to apparatus of the present invention are set forth below with reference to the appended figures.

Embodiments of packages of the present invention may be advantageously produced utilizing a packaging system, a method, or an apparatus of the present invention, or may be produced by other means.

The present invention is described in more detail with reference to specific embodiments illustrated in the Figures comprising fibers. Although these following specific embodiments are described with reference to fibers, it should be understood that analogous embodiments comprising bulk materials, bulk fiber materials and fibrous materials are also within the scope of the present invention.

FIG. 1 depicts an embodiment of a package of the present invention. As shown in FIG. 1, a package 2, may comprise a substantially cubiodal shape having a top surface 12, bottom surface 14, and side surfaces 16, 18, 20 and 22. The surfaces will preferably be substantially flat such that any crowning or doming of any surface will be less than 8 cm, preferably less than 5, more preferably less than 3 cm and in certain embodiments less than 1 cm. This dimension is shown in FIG. 1 with reference to the top surface 12 as "A".

Figure 2:
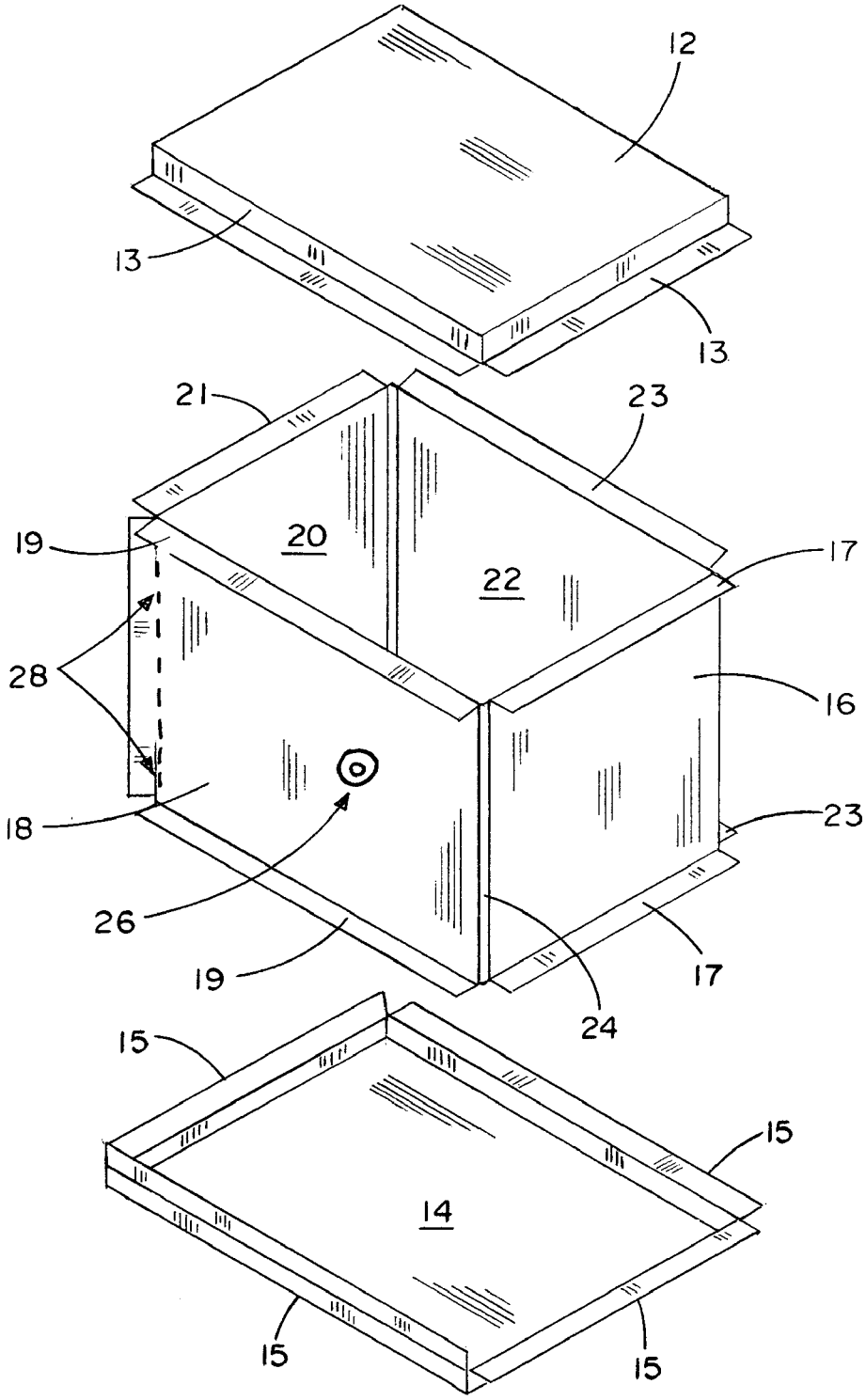
FIG. 2 illustrates, in exploded view, a possible embodiment of a chamber for use in an embodiment of the present invention.

FIG. 2 provides an exploded view of a possible embodiment of a chamber for an embodiment of the present invention. As shown in FIG. 2, a sealed chamber may comprise a plurality of walls including a top wall, 12, a bottom wall 14, and side walls 16, 18, 20 and 22. The side walls may be formed from a single sheet material which is folded and glued, for example at seam 24. This configuration may be referred to as a girth piece. In certain embodiments the top wall 12 will be slightly larger than the bottom wall 14 to facilitate use in certain machinery.

Each wall may comprise a polymeric film or similar sealable, preferably hermetically sealable material, suitable polymeric films are set forth above. In the embodiment depicted in FIG. 2, a laminate construction is utilized wherein each wall comprises a polymeric film and a barrier element, structural support or protective material. This element may comprise aluminum, tin, cardboard or a similar material.

Embodiments of the present invention may utilize different wall materials and laminates to achieve properties desired for a particular end use. The wall materials, or each layer in the case of a laminate, may have different moisture and gaseous permeabilities. In an embodiment of the present invention wherein the wall materials comprise polymeric films, the films may protect against water vapor influx and provide an oxygen barrier and odor barrier. In a laminate construction a film in the laminate may be utilized as a moisture barrier and another film utilized as an oxygen barrier.

Generally for embodiments of the present invention where a moisture barrier is important a polymeric film wall element will have a water vapor permeability of 0.001 to 4.3 grams/milliliter ("g/ml") per 100 square inches per 24 hours at 38 C, preferably 0.003 to 0.3 g/ml at these conditions. Similarly, where an oxygen barrier is desirable, a wall element will have an oxygen permeability of 0.001 to 185, preferably 0.001 to 0.06 cubic centimeters per 100 square inches per 24 hours at 25 C. The wall elements may be combined in the form of a laminate. It may be advantageous for the external layer of the laminate to provide a moisture barrier that protects the oxygen barrier. For example, a polyethylene/polyethylene terephthalate/metal film laminate may be utilized wherein the polyethylene assists in creating and maintaining a seal, preferably a hermetic seal, the polyethylene terpthalate provides strength and a moisture barrier and the metal provides an odor and oxygen barrier. Other film laminates from the aforementioned list are possible including but not limited to: PE/Nylon/PET, PE/EVOH/PET/PE, SiOx-Nylon/Valéron®/LLDPE BONylon/Valeron®/LLDPE/EVOH/ULLDPE; Valeron®/BO Nylon/Metal/ULLDPE; and the like, wherein the order of materials indicates the cross-section of the laminate and Valeron® is a Valéron® Strength Film.

Valéron® Strength Film is manufactured and sold by a division of Illinois Tool Works, Inc., 3600 West Lake Avenue, Glenview, Ill. 60025. A general description of Valéron® Strength Film is provided in the following paragraphs from information provided by the manufacturer.

Valéron® Strength Film or Valéron® Film comprises a family of films that combine tear resistance, puncture resistance and tear propagation resistance in one laminated Film. The films may generally comprise polyethylene. The cross-laminated structure of Valéron® Films offers the ideal pattern for a high perforation resistance. Due to their unique multiple layer structure, any sharp object needs to perforate multiple layers before damaging the Valéron® Film. The films show an exceptional tear propagation resistance, while allowing stapling, nailing, sewing or punching without causing any damages.

Valéron® Strength Film may possess an ultimate tensile strength up to 2 times as high as the UTS achieved by standard polyethylene films with equal thickness. Valéron® Films are multilayers, built up by laminating multiple single layers to each other. The manufacturing process ensures high quality characteristics and features of these Strength Films. Due to their multi-layer construction, Valéron® Films show an enhanced moisture barrier, in comparison to other mono-extruded films. Valéron® Films resist to most of the commonly used chemical substances. Uncoated Valéron® Film can be printed according Flexo technology (solvent and water based inks). In order to reach a more universal printability, Valéron® Films are provided with a top coating. This top coating allows Valéron® Film to be printed with a variety of printing technologies, ranging from dot matrix, thermal transfer-, flexo UV-, offset (standard & UV)-, digital, inkjet (both piezo and bubble jet printers) to screenprinting.

Valéron® Film withstands temperatures ranging from −40° C. until +90° C. Contrary to other synthetic materials Valéron® Film doesn't get brittle while exposed at negative temperatures, and will assume high temperatures, showing an unique thermal stability due to its cross laminated structure.

Valéron® Films provided with a high performing coating, show an outstanding adherence of the image on the Valéron® Film, resisting scratching and rough handling, ensuring the end user his/her product to remain in its perfect shape even while exposed to a rough outdoor environment. Valéron® Films show a good UV resistance. This UV resistance can be increased by introducing UV stabilizers in the Valéron® Film.

Besides a waterproof membrane, showing a good chemical resistance, Valéron® Film is a substantially air tight barrier as well. Valéron® Films are multilayers, built up by laminating multiple single layers to each other. The manufacturing process allows Valéron® Film to incorporate a high sealable layer as well, providing high sealability into an application for both hot bar and impulse sealing.

The thickness of the wall material may vary depending on the particular end use of the package. Generally, to avoid excess weight for transport, wall thickness will be in the range of 0.0025 to 0.080 cm (1-32 mils), more typically 0.0127 to 0.038 cm (5-15 mils). For certain embodiments, the wall thickness is preferably sufficient to provide a measure of puncture and tear resistance. An embodiment of the present comprises 0.020 cm (8 mil) PE/PET/Aluminum laminate walls. An alternate embodiment comprises 0.025-0.0275 cm (10-11 mil) Tyvek® protective material (very fine, high density polyethylene fibers) and Valéron® Strength film.

Each wall may include perimeter flaps or pre-folded edges, identified in FIG. 2 as 13, 15, 17, 19, 21 and 23. The pre-folded edges provide a surface for sealing, to allow a seal that can withstand at least a partial vacuum in the chamber. The seals may be welded with heat, glued, taped or ultrasonically fused using techniques known in the art.

As will be appreciated by those of ordinary skill in the art, the chamber may be of many different sizes without departing from the present invention, thus the dimensions of each wall may vary depending on the quantity of material being packaged. In certain embodiments the size of the chamber after assembly will approximate the size of a conventional fiber bale designed to be used in process equipment. For example in an embodiment of the present invention comprising acetate tow fibers, the chamber may approximate the size of an acetate tow fiber bale. In these embodiments, the chamber, after assembly will be about 70 to 130 centimeters ("cm") in length, about 55 to 100 cm in width or depth and about 25 to 150 cm in height. Embodiments of the present invention are advantageous for commercial size packages.

At least one wall of the chamber includes an evacuator 26 that will allow the chamber formed by sealing the walls to each other to be evacuated. The evacuator may comprise a vacuum check valve conventionally utilized in the art of vacuum packaging, including vacuum check valves available from the following commercial sources Richmond Aircraft Co., Norwalk, Calif.; Menshen Packaging Co., Waldwick, N.J.; Anver Vacuum Equipment Co., Hudson, Mass.; and Plat-o-Matic Valves, Co., Cedar Grove, N.J. The vacuum check valve may be formed into a wall during manufacture of the wall, or may be heat sealed, glued, welded or fused into a wall after formation of the wall. The evacuator may also comprise a vacuum outlet of the present invention. For certain applications, a plurality of evacuators may be utilized, for example to reduce evacuation time.

In embodiments of the present invention, the vacuum check valve may be of a diameter to allow a press fit connection between the valve and a hose. For example, a press fit between a "male" end of a vacuum hose and a "female" end of the valve. The diameter may be selected to allow a flow rate and pressure that will permit the chamber to be evacuated in a short time frame. For example for a standard bale size chamber of 96 cm width, 121 cm length and 127 cm height, the diameter of the vacuum check valve may be 20 to 40 cm, preferably 25 to 38 cm. The size of the vacuum check valve may be advantageously selected based on the diameter of a hose utilized to pull the vacuum. As set forth above, a plurality of vacuum check valves may be utilized, of differing diameters. The number and size of the vacuum check valves may depend on the rate at which it is desired to remove air from the package.

Although a vacuum check valve is advantageous for use in embodiments of the present invention, other devices may be utilized. For example, a standard hose fitting may be provided in at least one wall of the chamber. The chamber could be evacuated using the standard hose fitting and then the area behind or over the hose fitting sealed, for example with additional film.

A vacuum outlet of the present invention, described in detail below with respect to FIGS. 6*a*, 6*b*, 6*c* and 6*d* may be advantageously utilized in embodiments of the present invention.

The embodiment depicted in FIG. 2 further includes a section 28 designed to facilitate opening the chamber for use of the fibers within the chamber. Section 28 may be referred to as an "easy open" feature. The construction of the easy open feature comprises a pull tape designed to be pulled to tear open the chamber along a defined path.

As will also be appreciated by those of ordinary skill in the art, the chamber illustrated in FIG. 1 may be assembled and filled in many different ways. For example, the bottom wall may be sealed to the side walls to form an open box-like configuration. Fiber may be placed into the thus formed chamber and the top wall placed over the fiber. The fiber is then compressed to a height substantially equal to the height of the chamber. The top wall may then be sealed to the side walls. After sealing, the interior of the chamber may be evacuated using the vacuum check valve and conventional vacuum generating equipment to reduce expansion forces acting on the internal walls of the chamber from the decompression and spring back of the compressed fiber.

Alternatively, a fiber may be compressed between the top and bottom walls of the chamber and the side walls wrapped around the compressed fibers and sealed to each other and the top and bottom walls. After sealing, and prior to release of compression, the chamber may be evacuated.

Another procedure is to form the chamber around a compressed fiber volume and release the compression force prior to evacuating the chamber. The compressed fiber will expand and be restrained by the walls of the chamber. Because no ambient air can enter the sealed package, the fibers will generally expand until a partial vacuum or differential pressure between the inside of the chamber and the external environment reach an equilibrium with the expansion forces of the fiber per surface area of the package. The overall density of fiber in the package will be less using this procedure as compared to evacuating the chamber with the fibers still subject to compressive force.

The amount of vacuum pulled from the chamber after sealing will depend on the material being packaged. Generally, sufficient vacuum is pulled to counter-act expansive forces within the material being packaged that could cause the material to expand. Typically an amount of vacuum greater than the theoretical calculated pressure is used to ensure expansive forces are neutralized. In embodiments of the present invention utilized for the packaging of bulk fiber materials, it may be advantageous to pull a vacuum greater than one-half atmosphere (greater than 0.5 $kg/cm^2$) from the chamber, typically up to one atmosphere (greater than 1 $kg/cm^2$) to ensure expansive forces are neutralized.

As described herein, in certain embodiments of the present invention, the edge portions of packaging material, e.g. laminates, are sealed to each other to completely surround the material being packaged. The sealing may be performed in a variety of manners, such as those described herein. Depending on the size of the package, the material being packaged, and the amount of vacuum, a fin seal may prove advantageous. A fin seal (fish type) may be produced utilizing techniques known in the art and a jaw type constant heat or induction sealer. In a production environment, it will generally be advantageous for the sealing operation to be performed quickly, so as to increase overall process throughput.

Typically, in order to assist with sealing, a laminate packaging material will comprise a sealing layer as the outermost layer. The sealing layer may comprise a heat sealable polymer with a melt index that minimizes sealing time. Generally, low density polyethylene (including ULLDPE or LLDPE) has been found to provide a useful combination of performance properties and sealing properties. The sealing layer may advantageously be of sufficient thickness to allow melted material to flow into the seams and secondary seams that overlap. The thickness may assist in minimizing leaks.

Figure 3:
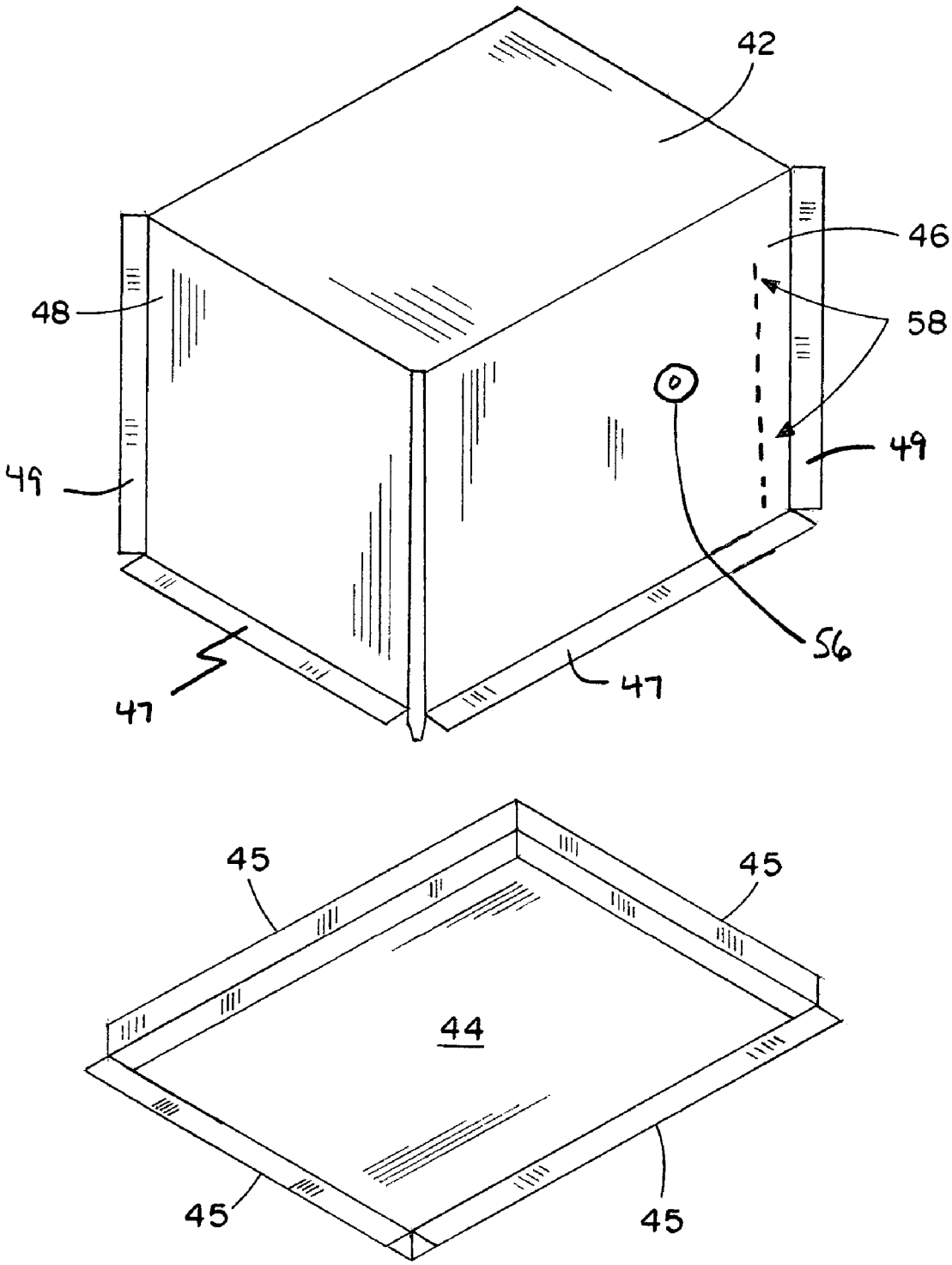
FIG. 3 illustrates, in exploded view, another possible embodiment of a chamber for use in an embodiment of the present invention.

FIG. 3 depicts an alternative embodiment of a chamber suitable for use in the present invention. As shown in FIG. 3, in an embodiment of the present invention top wall 42, may be pre-joined to side walls 46, 48, 50 (not shown) and 52 (not shown). The resulting "open box like" configuration may include pre-folded sealing edges or flaps 47, 49, 51 (not shown) and 53 (not shown). Bottom wall 44 may include pre-folded sealing edges or flaps 45. At least one wall will include an evacuator 56. In addition an easy open portion, 58 may be provided in one or more walls. The construction and materials utilized in the embodiment shown in FIG. 3 may be as described elsewhere herein.

The chamber depicted in FIG. 3 may be used in a variety of manners. For example fibers may be placed on the bottom wall and then the remaining chamber portions placed over the fibers and bottom wall and the bottom wall sealed to the side walls prior to evacuation.

Figure 4A:
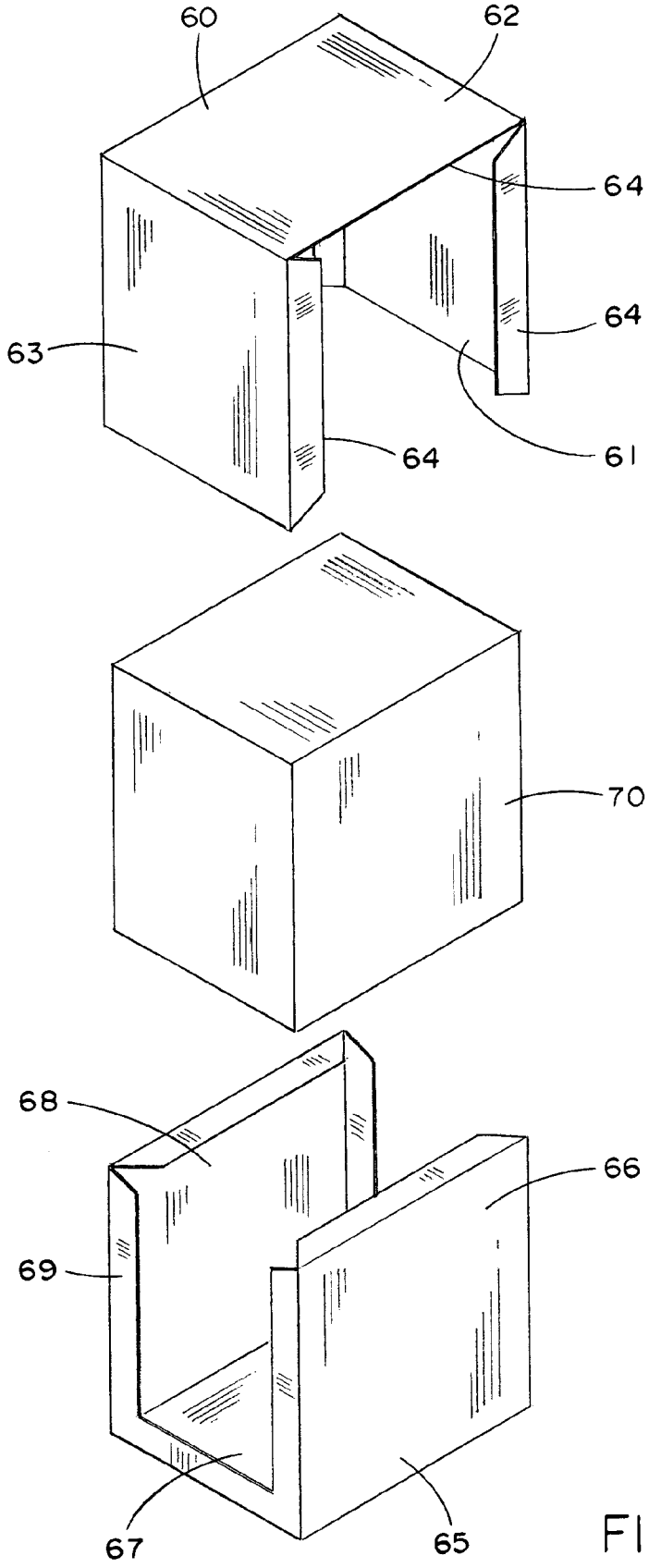
FIGS. 4A and 4B illustrate, in exploded and assembled views, an embodiment of a packaging system of the present invention.
Figure 4B:
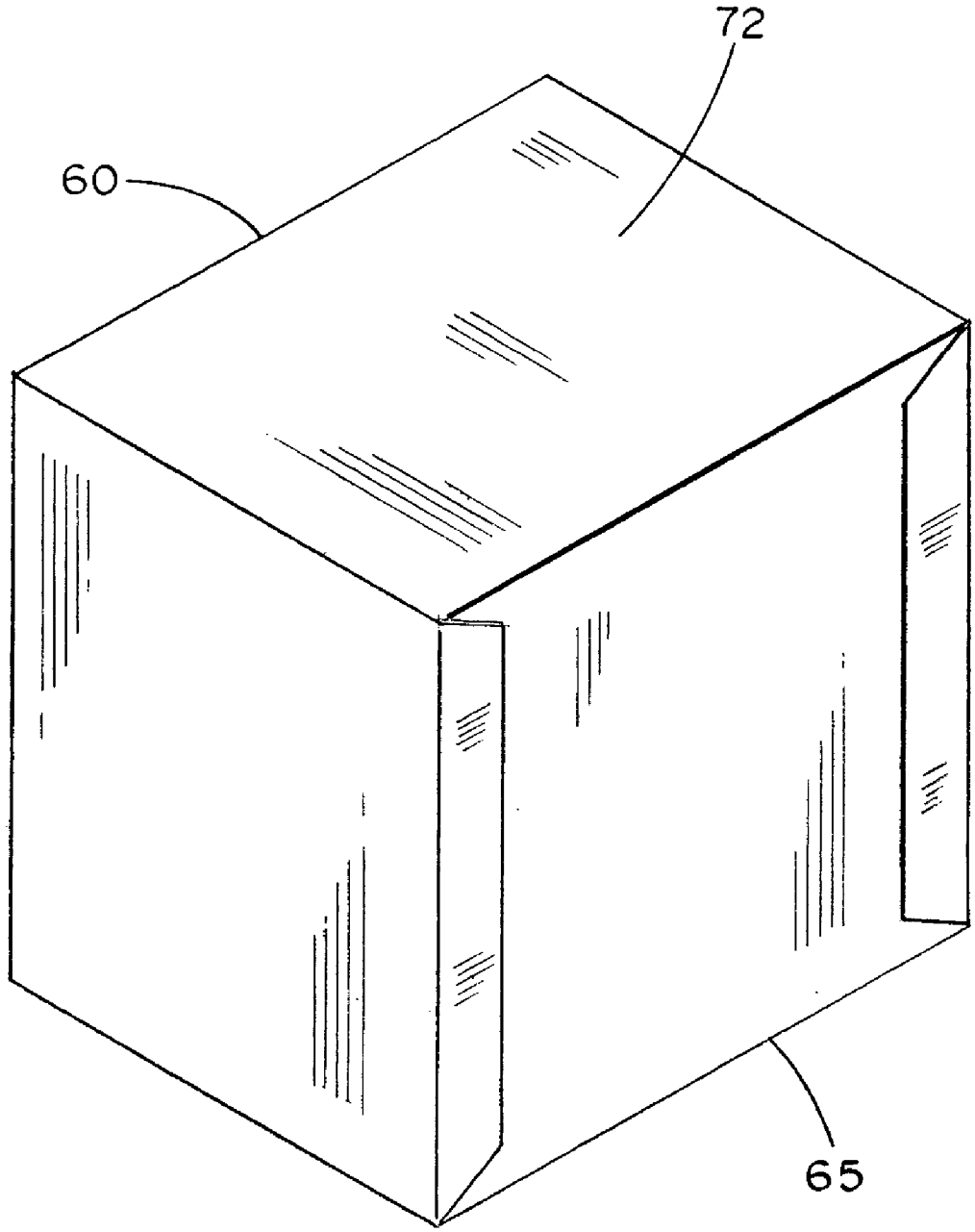

FIGS. 4A and 4B depict another possible embodiment of the present invention in exploded view and assembled views. Package 72 (FIG. 4*b*) comprises a U-joint type construction. As shown in FIG. 4A, three walls, top 62, side wall 61 and side wall 63, of the package are formed from a portion of a first U-shaped polymeric film 60 and the remaining three walls, bottom 67, side wall 66 and side wall 68, of the package are formed from a portion of a second U-shaped polymeric film 65. The edges of the U-shaped portions may further comprise sealing edges or flaps, one of which is identified in each portion as 64 and 69 respectively. At least one wall of at least one U-shaped portion comprises an evacuator.

The second U-shaped portion comprising the bottom 67 may be placed, for example on the bottom platen of a baler. A material to be packaged 70, for example a fibrous material, may be placed on top of the bottom 67. The first U-shaped portion 60, comprising the top 62 may then be placed on top of the material to be packaged 70. The side walls 61, 63, 65 and 68 may then be folded around the material and the edges sealed to the other side walls and top 62 and bottom 67 using the flaps to form package 72. The package may then be evacuated. Alternatively, the first U-shaped portion may be placed on top of the material and the material compressed prior to folding the side walls around the material and sealing.

Figure 5:
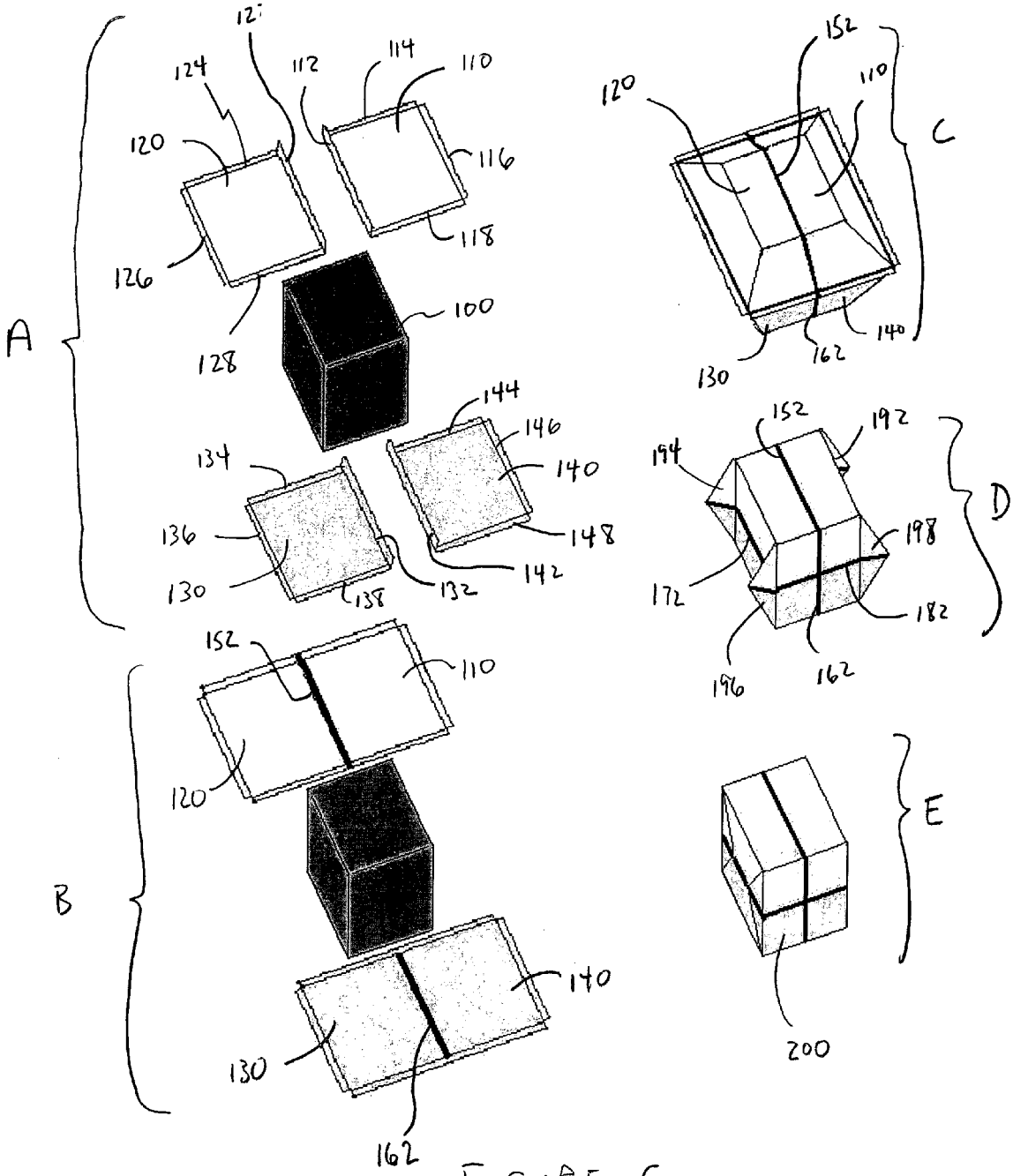
FIG. 5 illustrates the preparation of another possible embodiment of a package of the present invention, as well as the final configuration of the package.

FIG. 5 illustrates an alternate embodiment of the present invention. As shown in FIG. 5, a bulk material 100 may be packaged utilizing the present invention. Packaging material may comprise component parts 110, 120, 130 and 140, formed, for example from the types of laminates described herein.

To facilitate sealing, each component piece may include flange like edges, 112, 114, 116 and 118 on piece 110; 122, 124, 126, and 128 on piece 120; 132, 134, 136 and 138 on piece 130; and 142, 144, 146 and 148 on piece 140. In an initial step, "B", the edges of corresponding pairs may be sealed to form larger pieces. As shown in FIG. 5, edge 112 of piece 110 and edge 122 of piece 120 are sealed to form seal 152. Similarly, edge 132 of piece 130 and edge 142 of piece 140 are sealed to form seal 162.

As shown in "C" of FIG. 5, the larger pieces thus formed may be placed on the top and on the bottom of the bulk material to form a package with the bulk material inside. The remaining edges of the packaging material may then be sealed to completely seal the package. Seals 172 and 182 are shown in "D" of FIG. 5. Extra packaging material will form flaps, 192, 194, 196 and 198. The flaps may be folded over and sealed to the side walls of the package to form a package of the present invention, 200, as shown in FIG. 5 "E".

As will be realized from the description contained herein, at least one piece of packaging material may include an evacuator to facilitate creation of a vacuum within the package.

FIGS. 2, 3, 4 and 5 illustrate substantially cubiodal chambers that will form substantially cubiodal packages. The present invention includes packages of different shapes. In addition, the present invention includes packages of non-uniform or random shapes. As will be understood from the description contained herein, the principals of the present invention may be utilized with chambers in the forms of bags to produce packages that conform to the shape of the fibers in the interior volume of the bag. Many of the features and advantages of the present invention will be achieved with non-uniform packages, although such packages may be less advantageous for stacking and palleting.

As discussed above, packages of the present invention are advantageous for use with a wide variety of fibers. An embodiment of the present invention comprises a package for acetate tow fibers of the type utilized for filter material. In this embodiment a package of the present invention may comprise: a sealed chamber at a pressure less than atmospheric pressure, the interior volume of the chamber comprising acetate fibers.

Figure 6A:
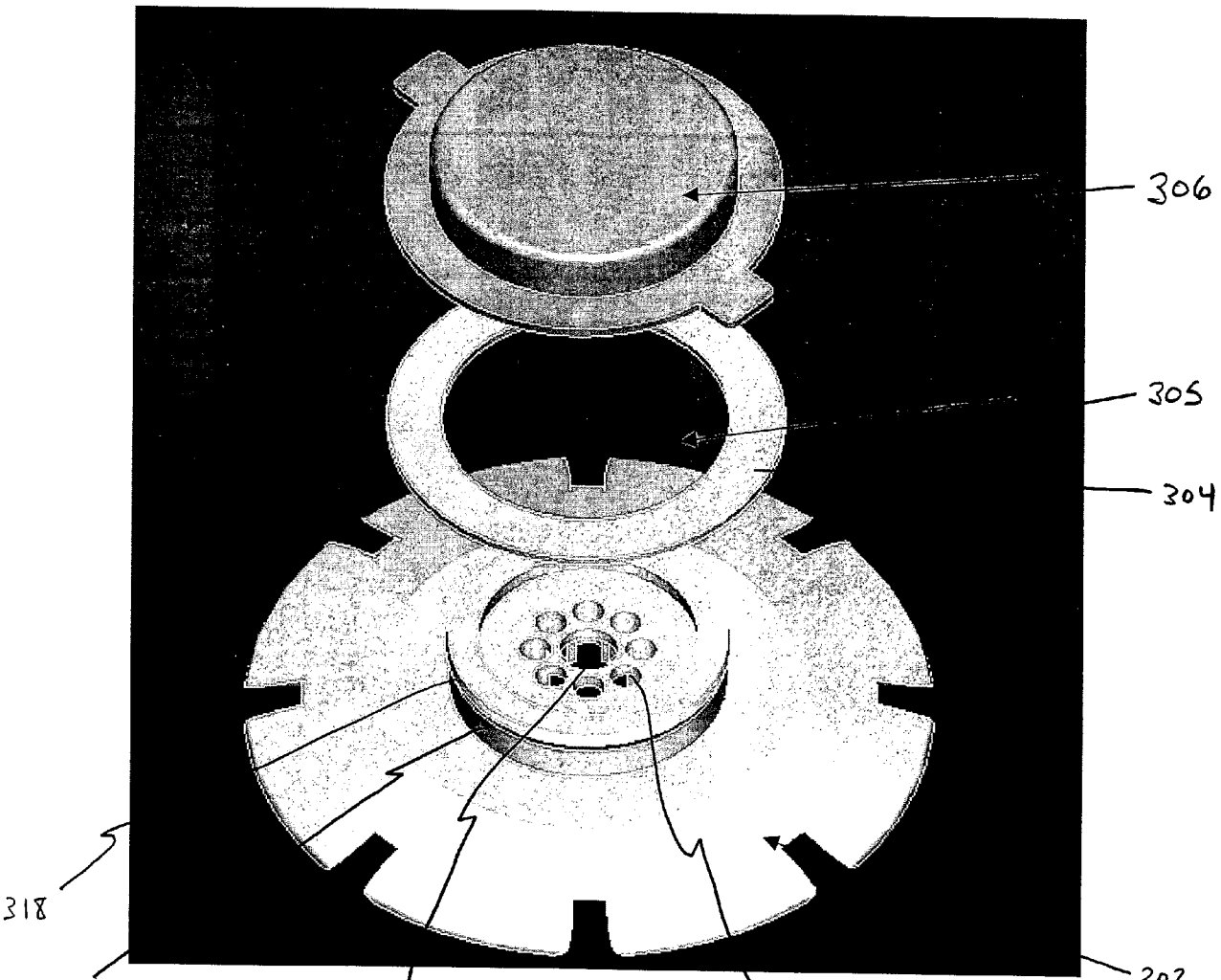
FIGS. 6A, 6B, 6C and 6D provide views of an embodiment of a vacuum outlet assembly of the present invention.

FIGS. 6A, 6B, 6C and 6D depict a vacuum outlet assembly of the present invention, suitable for use as an evacuator in embodiments of the present invention. As shown in FIG. 6A in exploded view, a vacuum outlet assembly may comprise a vacuum outlet 302, gasket 304, and cap 306. The vacuum outlet comprises an aperture 312 that permits air flow between the interior and exterior of a package. The aperture may include multiple holes 314, or a single hole. The aperture may advantageously take the form of a check valve that allows one way flow from the interior to exterior of a package.

Figure 6B:
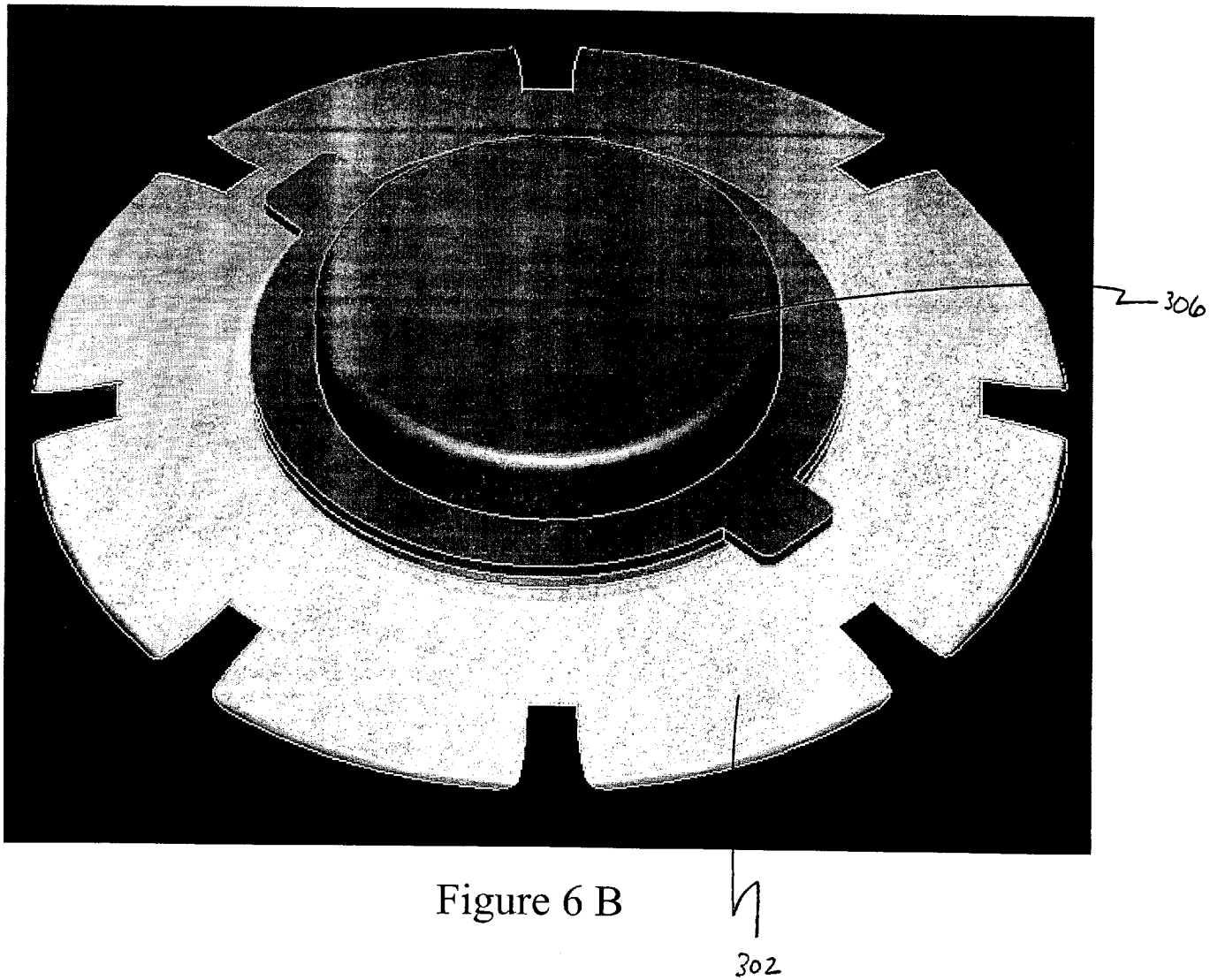

As shown in FIG. 6A, the aperture portion may be raised with respect to the base, 304 of the vacuum outlet, creating wall 316 that allows the aperture to extend through packaging material. The portion of wall 316 that will protrude through the packaging material may comprise a flanged portion 318 to facilitate connection to a vacuum drawing device. In use, the base 302 is placed on one side of packaging material and wall 316 extends through hole or slits in the packaging material such that flange 318 is on the opposite side of the packaging material than base 302. Gasket 304, having opening 305 adapted to fit around the walls 316 of outlet 302 may be placed over the flange to secure the assembly. In addition, the assembly may be glued and/or sealed to the packaging material. Cap 306 is provided to seal the aperture 312 as shown in FIG. 6B. Alternatively, 312 may be sealed with glue or packaging material after a vacuum has been drawn.

The vacuum outlet assembly may be formed from a moldable and/or machinable materials, including but not limited to polymeric material including nylon, LLDPE, or the like; metal; wood etc. The vacuum outlet assembly may be produced by molding and/or machining using conventional techniques.

Figure 6C:
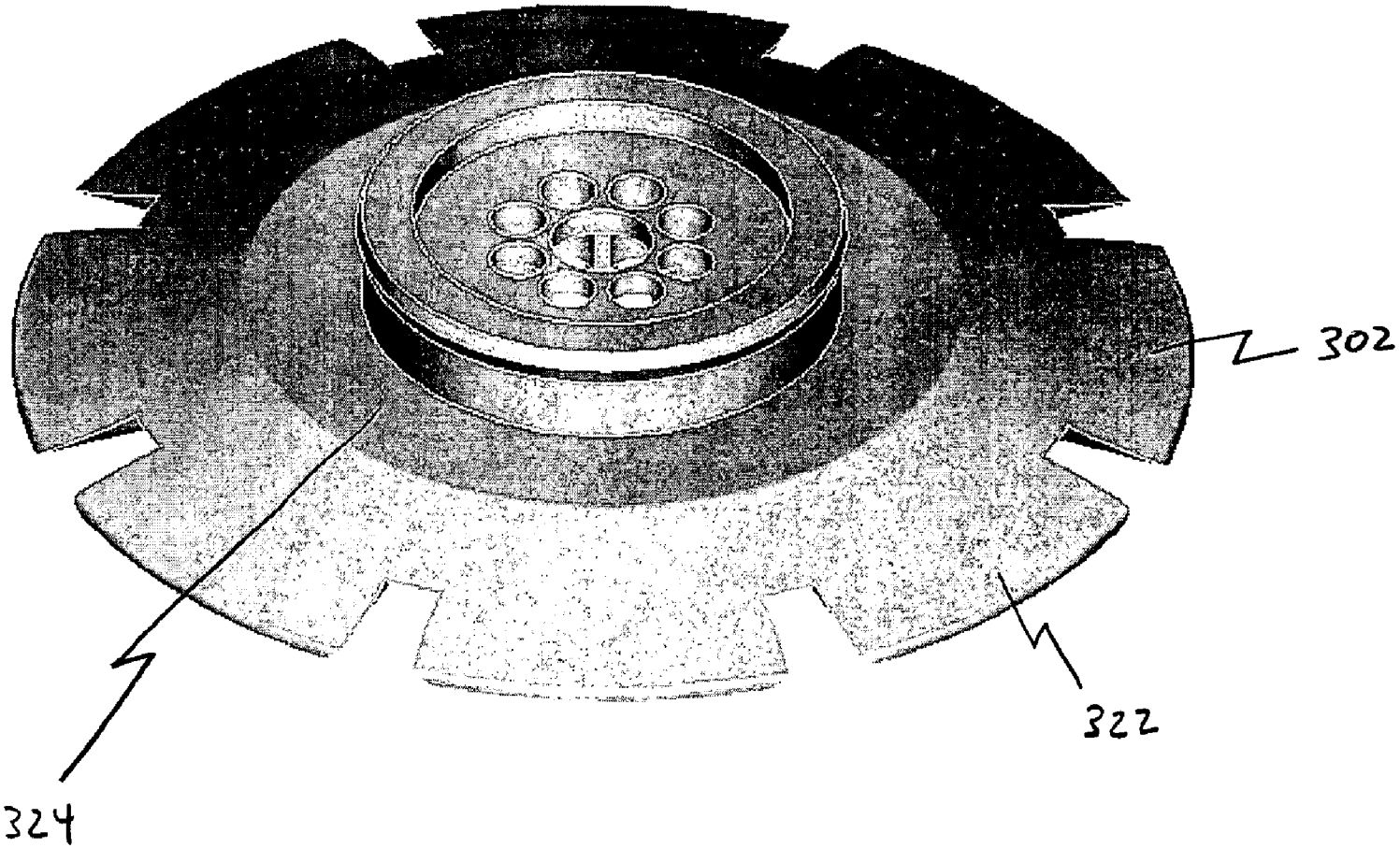

FIG. 6C provides additional detail on an embodiment of the vacuum outlet 302. As shown in FIG. 6C, vacuum outlet 302 may be substantially circular and include radially extending pieces 322 for strength. In addition, the vacuum outlet may include a sloped plateau portion 324 near the aperture.

Figure 6D:
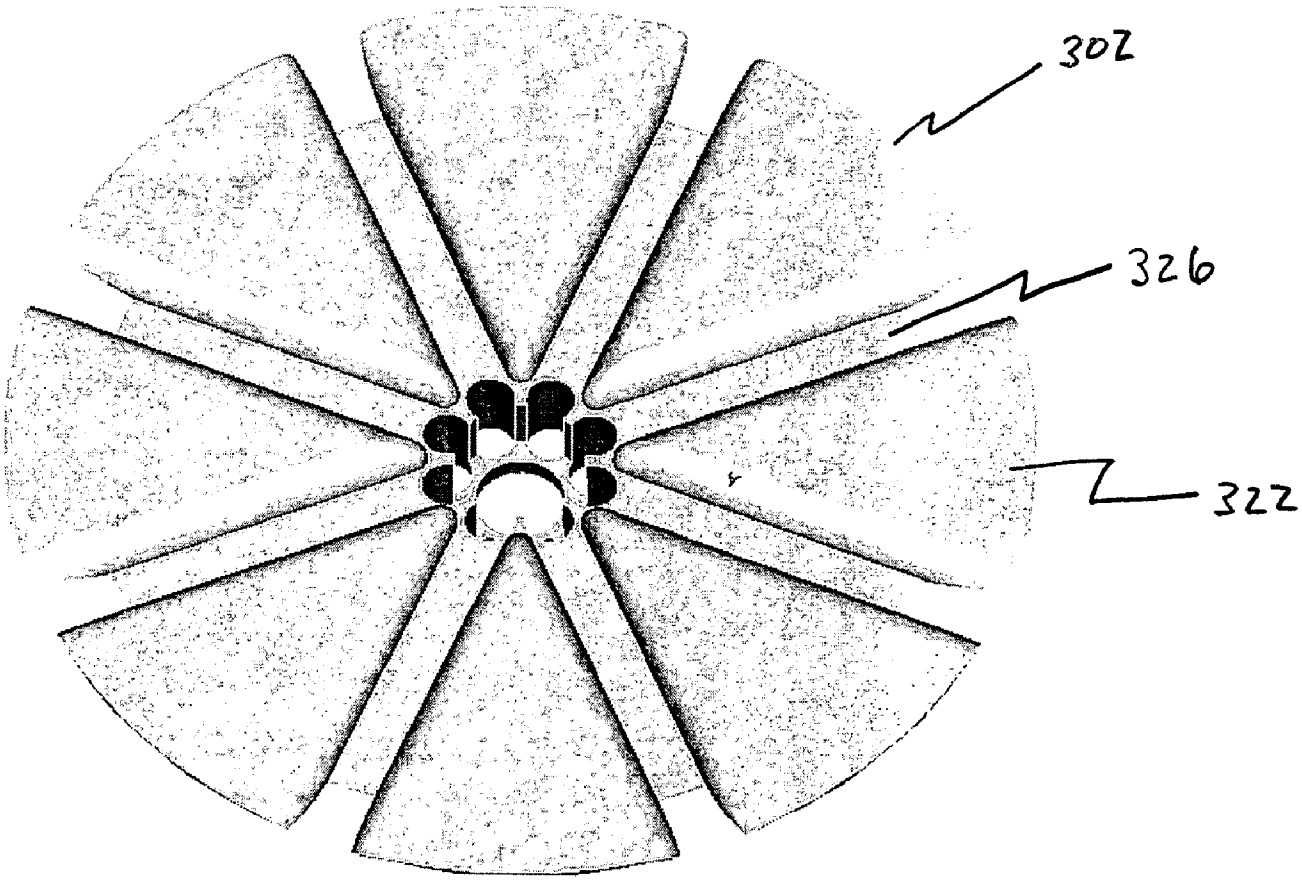

As shown in FIG. 6D the underside of vacuum outlet 302 may comprise channels 326 and wedge portions 322 corresponding to the radially extending pieces. The channels and wedge portions help provide structural shape to the vacuum outlet assembly.

In the embodiment depicted in FIGS. 6A, 6B, 6C and 6D, the vacuum assembly is substantially round and the connector to a vacuum drawing device is round. As will be understood by those of ordinary skill in the art, others shapes and designs may be useful. In general, the base of the vacuum assembly will be larger than the aperture to provide structural support to the aperture and the package walls. The larger base assembly will also help prevent the assembly from pulling through the walls of the package and provide a larger sealing surface. Generally, the base is 1.5 to 20 times larger than the aperture. In an embodiment of the present invention, the diameter of the aperture was approximately 26 centimeters and the diameter of the base was approximately 80 centimeters.

Figure 7:
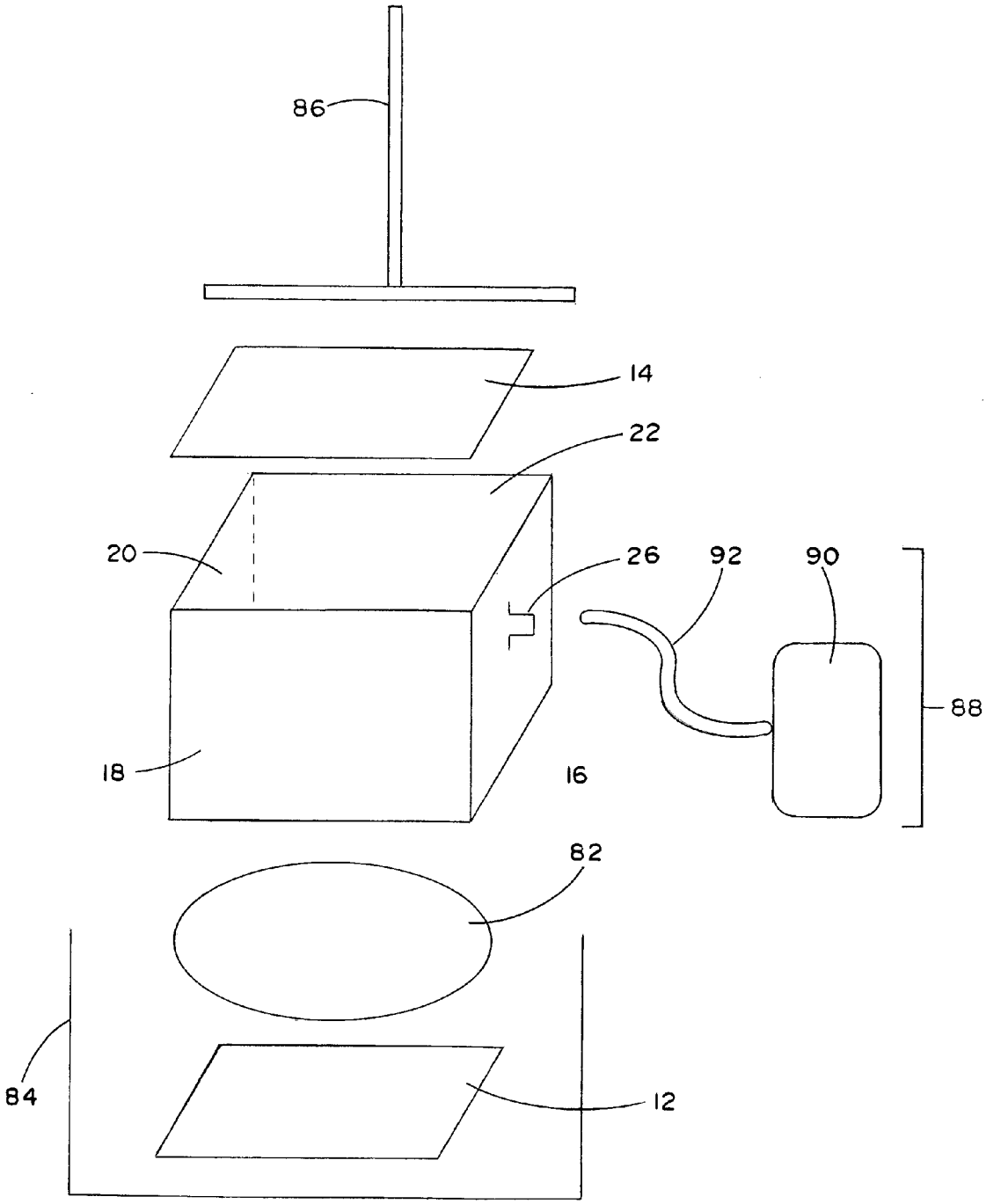
FIG. 7 illustrates an embodiment of an apparatus of the present invention.

An embodiment of an apparatus of the present invention is depicted in FIG. 7. As shown in FIG. 7 and apparatus of the present invention may comprise a packaging system of the type depicted in FIG. 2. The apparatus may further comprise a vessel 84 suitable for receiving fibers 82 and a ram 86. The ram may be hydraulic and operated by motors and associated control equipment (not shown). The apparatus may further comprise an evacuation system 88. The evacuation system comprises a vacuum pulling device 90 and associated hoses 92 adapted to be connected to an evacuator 26 in a wall of the packaging system.

For use, the bottom surface of a packaging system may be placed in the vessel. Fibers may be placed on top of the bottom surface and the side surfaces and top surface placed around the fibers. The fibers may then be compressed using ram 86. After compression, the hose 92 from evacuation system 88 may be connected to evacuator 26 to remove air and gases from the chamber until the chamber reaches a desired pressure less than ambient atmospheric pressure.

Further features and advantages of the present invention are illustrated by the following example.

EXAMPLE 1

The advantages of an embodiment of a package of the present invention comprising fibers are illustrated with reference to a typical prior art bale referred to as a control.

Baling equipment manufactured by Lummus Corporation, Savannah, Georgia was utilized to produce a typical prior art bale as a control, and an embodiment of the present invention.

Control Bale

The baler bin was filled with acetate tow to a level so that after compression the bale dimensions were approximately 94 centimeters ("cm") in width, 122 cm in length and 112 cm in height. After removal of compressive force the new bale dimensions were approximately 99 cm in width, 127 cm in length and 123 cm in height.

The bale was then packaged with cardboard and plastic sheets along the sides of the bale and 10 plastic straps surrounding the bale. After removal from the baling equipment the bale was stored and grew approximately 18 cm in height for a approximate bale dimension of 99 cm in width, 127 cm in length and 141 cm in height The density of the bale was about 0.4 grams per cubic centimeter and the bale weighed approximately 726 kilograms (kg). The resulting bale had strap indentation that were apparent on visible inspection and was domed approximately 5 cm in the center on the top and bottom. As a result, the bale was insufficiently flat and had to be stacked on its side.

Present Invention

An embodiment of a package of the present invention was produced utilizing the following procedure. The package utilized was substantially as shown in FIG. 2.

The bottom wall was installed on the lower section of a fiber-holding chamber of processing equipment conventionally utilized to compress and bale fibers. The fiber holding chamber was filled with acetate tow fiber on top of the bottom wall. The top wall was placed over the fiber accumulated in the chamber. A compression cycle was performed to create a rectangular cubiodal shape. While maintaining compression, the chamber walls of the fiber-holding chamber were removed and the girth wrap (side walls) were wrapped around the compressed acetate tow. An airtight seal was made on the pre-folded edges of the forward and trailing edges of the girth wrap by heat sealing. The matching pre-folded edges of the top and bottom of the girth wrap, top wall, bottom wall were also sealed by heat sealing, thereby creating a hermetically sealed chamber.

A vacuum hose was applied to the vacuum check valve in a side wall (panel of the girth wrap) of the chamber. The chamber was evacuated by pulling a vacuum until the expansion forces of the acetate tow fiber reached equilibrium and the acetate tow fiber applied little or no outward forces on the walls of the chamber. The vacuum hose was removed and the vacuum check valve retained the vacuum in the chamber. The compression from the processing equipment was released.

Upon removal from the baler the resulting package retained a substantially cubiodal shape with approximately the following dimensions 98 cm width, 123 cm length, 127 cm height and contained approximately 975 kilograms of acetate tow fiber. The average density of acetate tow fibers within the package was approximately 0.64 grams per cubic centimeter.

Expansion was minimal during storage with the package retaining a substantially cubiodal shape with approximately the following dimensions 98 cm width, 123 cm length, and 129 cm height. The bale was substantially flat on the top and bottom to within 0.35 centimeters.

EXAMPLE 2

This Example illustrates embodiments of the present invention.

A package of the present invention was formed in the manner indicated in FIG. 5 by splicing portions of a Bx4 Nylon/Valeron/ULLDPE film together to form two film pieces approximately 243 centimeters by 269 centimeters. Other laminates such as PET-SiOx/Valeron/ULLDPE would be expected to perform in a similar fashion.

A hole, approximately 2.8 centimeters in diameter was punch cut into one of the film pieces to provide an aperture for a vacuum outlet assembly substantially as described in FIGS. 6A, 6B, 6C and 6D. A heat sealer was used to seal the vacuum outlet assembly to the film piece.

The other film piece was then placed in the baler bin of a conventional baling apparatus, such as described elsewhere herein.

Cellulose acetate tow fibers were fed into the baler bin, on top of the film piece, to provide a finished compressed bale approximately 127 centimeters tall.

The first film piece was then placed over the platen of the baling apparatus so that when the platen moved to compress the cellulose acetate tow fibers the film piece would cover the top and top side portions of the fibers.

The fibers were then compressed.

While maintaining compression, the sides of the baling bin were dropped and the edges of the first and second film pieces were sealed to each other using fin seals, as illustrated in FIGS. 5C and 5D.

A soft rubber gasket was placed over the portion of the vacuum outlet assembly extended through the film.

Using a vacuum source and a hose connection to the vacuum outlet assembly aperture, a small vacuum was pulled on the package to create a differential pressure to remove excess air before straightening the package.

The edges of the film were then pulled taut, to remove folds and wrinkles, folded over and sealed, as illustrated in FIGS. 5D and 5E to form a substantially square package.

Using the vacuum source and hose connection, vacuum pulling was continued until a substantially constant vacuum of approximately 0.90 kg/cm$^2$ was obtained.

The hose was disconnected and a cap placed over the aperture.

The compressive force exterted by the baler platen was removed and the resulting bale removed from the baler. A conventional shrink wrap was placed over the bale and the bale checked for vacuum leaks.

The result was a package of the present invention.

Although the present invention has been described with reference to particular embodiments, those of ordinary skill in the art will appreciate that the system of the present invention may be implemented in other ways and embodiments. Accordingly, the description herein should not be read as limiting the present invention as other embodiments also fall within the scope of the present invention.

The invention claimed is:

1. A fiber bale package comprising, a sealed chamber comprising a bulk material, wherein the bulk material comprises fibers, wherein the density of the bulk material in the sealed chamber is from 0.48 to 0.82 g/cm$^3$;

wherein the sealed chamber comprises a top wall, a bottom wall and a plurality of side walls;

wherein the package has a substantially cuboidal shape;

wherein the top and bottom walls of the sealed chamber are substantially flat;

wherein at least one wall comprises an evacuator; and wherein the initial pressure in the sealed chamber is less than ambient atmospheric pressure.

2. The fiber bale according to claim 1, wherein the fibers comprise cellulose acetate fibers.

3. The fiber bale according to claim 1, wherein the walls are comprised of a polymeric film.

4. The fiber bale according to claim 1, wherein the walls are comprised of one or more of: polyethylene, polypropylene, ethylene vinyl alcohol polymer, nylon, mylar, polyethylene terephthalate, polyethylene terephthalate glycol, polyimides, polyamides, biaxially oriented nylon, linear low density polyethylene, or ultra linear low density polyethylene.

5. The fiber bate according to claim 1, wherein the walls provide one or more of a gaseous barrier, a moisture barrier, or an odor barrier.

6. The fiber bale according to claim 1, wherein the dimensions of the bale are from 80 cm to 120 cm in width, from 100 cm to 150 cm in length, and from 105 cm to 155 cm in height.

7. The fiber bale according to claim 1, wherein the sealed chamber has an internal volume from 0.9 to 2.3 m$^3$.

8. The fiber bale according to claim 1, wherein the height of the center of the top wall is less than 6.3% greater than the height of an edge of the top wall.

9. The fiber bale according to claim 1, wherein the height of the center of the top wall is less than 2.4% greater than the height of an edge of the top wall.

10. The fiber bale according to claim 1, wherein the initial pressure in the sealed chamber is from 16,000 Pa to less than ambient atmospheric pressure.

11. The fiber bale according to claim 1, wherein the initial pressure in the sealed chamber is from 40,000 Pa to 92,000 Pa.

12. The fiber bale according to claim 1, wherein the initial pressure in the sealed chamber is from 50,000 Pa to 70,000 Pa.

13. The fiber bale according to claim 1, the density of the bulk material in the sealed chamber is from 0.50 to 0.78 g/cm$^3$.

* * * * *